US011311150B2

(12) United States Patent
Smith et al.

(10) Patent No.: US 11,311,150 B2
(45) Date of Patent: Apr. 26, 2022

(54) SHOWER ENCLOSURE AND METHODS OF INSTALLATION

(71) Applicant: Bruskin International, LLC, Van Nuys, CA (US)

(72) Inventors: Albert Barry Smith, Los Angeles, CA (US); Conrad Saks, Los Angeles, CA (US); Mark E. Dannettel, Los Angeles, CA (US)

(73) Assignee: BRUSKIN INTERNATIONAL, LLC, Van Nuys, CA (US)

( * ) Notice: Subject to any disclaimer, the term of this patent is extended or adjusted under 35 U.S.C. 154(b) by 0 days.

(21) Appl. No.: 16/538,010

(22) Filed: Aug. 12, 2019

(65) Prior Publication Data

US 2020/0100624 A1 Apr. 2, 2020

Related U.S. Application Data

(63) Continuation of application No. 15/842,235, filed on Dec. 14, 2017, now Pat. No. 10,405,702, which is a continuation of application No. 14/997,389, filed on Jan. 15, 2016, now Pat. No. 9,883,777.

(60) Provisional application No. 62/264,849, filed on Dec. 8, 2015, provisional application No. 62/104,679, filed on Jan. 16, 2015.

(51) Int. Cl.

| | |
|---|---|
| ***A47K 3/28*** | (2006.01) |
| ***A47K 3/40*** | (2006.01) |
| *A47K 3/30* | (2006.01) |

(52) U.S. Cl.

CPC ..... *A47K 3/284* (2013.01); *A47K 3/283* (2013.01); *A47K 3/40* (2013.01); *A47K 3/281* (2013.01); *A47K 2003/307* (2013.01)

(58) Field of Classification Search

CPC ..... A47K 3/284; A47K 3/281; A47K 3/283

USPC ..... 4/614; 52/489.1, 173.1

See application file for complete search history.

(56) References Cited

U.S. PATENT DOCUMENTS

| | | | |
|---|---|---|---|
| 1,794,941 | A | 3/1931 | Barce |
| 1,806,668 | A | 5/1931 | Bulthuis |
| 2,010,864 | A | 8/1935 | Jones |

(Continued)

FOREIGN PATENT DOCUMENTS

| | | | |
|---|---|---|---|
| EP | 0107739 | A1 | 5/1984 |
| EP | 0731224 | A1 | 9/1996 |

(Continued)

*Primary Examiner* — Lauren A Crane

(74) *Attorney, Agent, or Firm* — Walter W. Duft

(57) ABSTRACT

Exemplary embodiments provide a prefabricated modular shower enclosure, including a base with a plurality of engagement feature along a peripheral surface of the base, a plurality of alignment supports, and a surround panel. In some embodiments, at least one alignment support is positionable in a preselected relationship relative to the engagement features of the base, and the alignment supports are configured to be independently made square relative to the base. Additional exemplary embodiments provide a prefabricated shower enclosure, including a base with a plurality of engagement feature along a peripheral surface of the base, and a plurality of surround panels that engage the base. The modular shower enclosure reduces installation time and complexity by using components that are fabricated and cut to size offsite prior to installation at a job site.

20 Claims, 32 Drawing Sheets

(56) References Cited

U.S. PATENT DOCUMENTS

| | | | | |
|---|---|---|---|---|
| 2,282,329 | A | 5/1942 | Johnson | |
| 2,993,212 | A | 7/1961 | Ruhm | |
| 3,420,021 | A | 1/1969 | Anghinetti et al. | |
| 3,561,182 | A | 2/1971 | Madi, Jr. | |
| 3,751,737 | A | 8/1973 | Mustee | |
| 3,757,358 | A | 9/1973 | Chisholm et al. | |
| 3,845,600 | A | 11/1974 | Moore | |
| 3,958,372 | A | 5/1976 | Benbow | |
| 4,370,838 | A * | 2/1983 | Vermillion | E04F 13/0814 52/127.9 |
| 4,459,760 | A | 7/1984 | Watson | |
| 4,459,790 | A | 7/1984 | Vermillion | |
| 4,987,619 | A | 1/1991 | Smith | |
| 4,993,201 | A | 2/1991 | Bunyard | |
| 5,115,604 | A | 5/1992 | Bunyard | |
| 10,041,249 | B1 * | 8/2018 | Hebert | E06B 11/00 |
| 2009/0313932 | A1 | 12/2009 | Montgomery | |
| 2011/0203046 | A1 | 8/2011 | Donnelly et al. | |
| 2013/0047540 | A1 * | 2/2013 | Cosma | E04F 13/0825 52/489.1 |
| 2013/0264240 | A1 * | 10/2013 | Wallis | B65D 85/00 206/459.5 |
| 2015/0000218 | A1 | 1/2015 | White | |

FOREIGN PATENT DOCUMENTS

| | | | |
|---|---|---|---|
| EP | 0731227 | A1 | 9/1996 |
| EP | 1116466 | A2 | 7/2001 |
| EP | 2182140 | A1 | 5/2010 |
| WO | WO2010037938 | A2 | 4/2010 |

* cited by examiner

SHOWER ENCLOSURE AND METHODS OF INSTALLATION

CROSS-REFERENCE TO RELATED APPLICATIONS

The present application is a continuation of U.S. patent application Ser. No. 15/842,235 filed on Dec. 14, 2017, which is a continuation of U.S. patent application Ser. No. 14/997,389 filed on Jan. 15, 2016 (now U.S. Pat. No. 9,883,777), which claims priority to and the benefit of U.S. Provisional Application Ser. No. 62/104,679 filed on Jan. 16, 2015, the entire content of which is hereby incorporated by reference, and U.S. Provisional Application Ser. No. 62/264,849 filed on Dec. 8, 2015, the entire content of which is hereby incorporated by reference.

FIELD OF INVENTION

The present invention relates to a modular shower system and methods of installation, and more particularly to a shower system in which a plurality of components are supplied ready for assembly.

BACKGROUND

The hospitality and multifamily housing industries are transitioning to bathrooms that utilize showers rather than bathtubs. Showers may be preferable to bathtubs because showering is generally faster than bathing and because showers use significantly less water on average than bathtubs. In renovation projects, bathtubs are taken out and are being replaced with showers. In new shower projects, showers are being installed as preferable to bathtubs.

For project owners and developers, low cost and ease of installation are key factors in deciding on a system to use in their projects. Existing new and replacement shower installations are labor and time intensive, requiring the inconvenience of cutting and measuring materials on site, coordinating between multiple workers in different trade areas, and time for adhesives and cement to dry. The current install time for showers is around six hours and requires two to three skilled laborers across three different trade areas. Most shower systems today use a 60×32 inch shower pan to replace the bathtub and then use sheets of synthetic material, which must be cut to size on site to cover the walls. Separate shower doors are then installed.

SUMMARY OF THE INVENTION

Accordingly, there is a need for a shower system which reduces on site installation time, complexity, and the number of necessary trade areas for completion.

The present disclosure provides a pre-fabricated modular shower enclosure that may be delivered to a job site as a collection of components requiring only simple assembly. The prefabricated components can be customized per a client's specifications and little to no adjustment is required on site during installation. The prefabricated components can be produced at an offsite manufacturing facility and installation of the prefabricated components can be performed without requiring measuring and cutting pieces to desired lengths, without requiring expensive and time consuming tiling operations, and without the long delay associated with typical adhesive and cement drying times.

In some embodiments, the modular shower enclosure includes a base, a plurality of alignment supports, and a plurality of surround panels. The surround panels include panel sheets with a surface that faces an interior of the shower enclosure. Because the surround panels are prefabricated, they can be made out of materials that cannot be cut to size on the job site, such as glass. The panel sheets may be offered in a range of styles and materials per customer preferences, including decorative glass, engineered stone, solid surface materials, porcelain, and fine art glass. The base can serve as an organizing template for the shower enclosure. The base has engagement features along a peripheral surface of the base. In some embodiments, at least one of the alignment supports is positionable in a preselected relationship relative to engagement features of the base. The alignment supports can be arranged in a preselected "square" position relative to the base to provide precisely vertical mounting surfaces that accommodate for alcove walls that are out of plumb. The alignment supports, in some embodiments, are configured to engage the base. In some embodiments, the engagement features are slots that are configured to receive lower portions of the alignment supports. The alignment supports are metal support members that provide structural support for the surround panels and connect the surround panels to the shower enclosure. The alignment supports may be mounted to an existing alcove in the building. In some embodiments, the alignment supports are vertical support members. In some embodiments, the alignment supports are horizontal support members.

In some embodiments, the modular shower enclosure includes one or more rear surround panels. The rear surround panels serve as a rear wall of the enclosure and include coupling portions on a back side of the rear surround panel. The coupling portions of the rear surround panels engage coupling mounts on rear alignment supports. In some embodiments, the coupling portions of the rear surround panels are downward extending protrusions that are vertically received in the coupling mounts of the rear alignment supports.

In some embodiments, a rear surround panel and a side surround panel each include interlocking rails configured to engage each other at rear corners of the modular shower enclosure. The interlocking rails can each include finger-like engagements.

In some embodiments, the modular shower enclosure includes multiple side surround panels. The side surround panels serve as side walls of the shower enclosure and include coupling portions on back sides of the side surround panels. The coupling portions of the side surround panels horizontally engage coupling mounts on side alignment supports. In some embodiments, the coupling portions of the side surround panels are flanges that are horizontally slid into lengthwise flanges in the alignment supports.

In some embodiments, the modular shower enclosure includes front closure assemblies and side closure assemblies that are horizontally expandable and compressible to account for out of plumb alcove walls.

In some embodiments, the modular shower enclosure includes a lid.

In some embodiments, the modular shower enclosure includes lighting elements, which may be incorporated into rear surround panels, side surround panels, and/or a lid.

In some embodiments, a tool for installing a modular shower enclosure is provided. The tool can include a vertical edge to align the alignment supports for installation and a horizontal edge to extend across a planar surface of the base.

In some embodiments, the modular shower enclosure includes surround panels that connect to the base via mounting rails. The mounting rails in some embodiments engage slots in the base. In some embodiments, mounting rails engage wall connectors to connect to an alcove. In some embodiments, the mounting rails are adjustably connected to the wall connectors at a variety of different engagement locations to plumb the surround panels. In some embodiments the variety of different engagement locations are slots.

DETAILED DESCRIPTION

Figure 1:
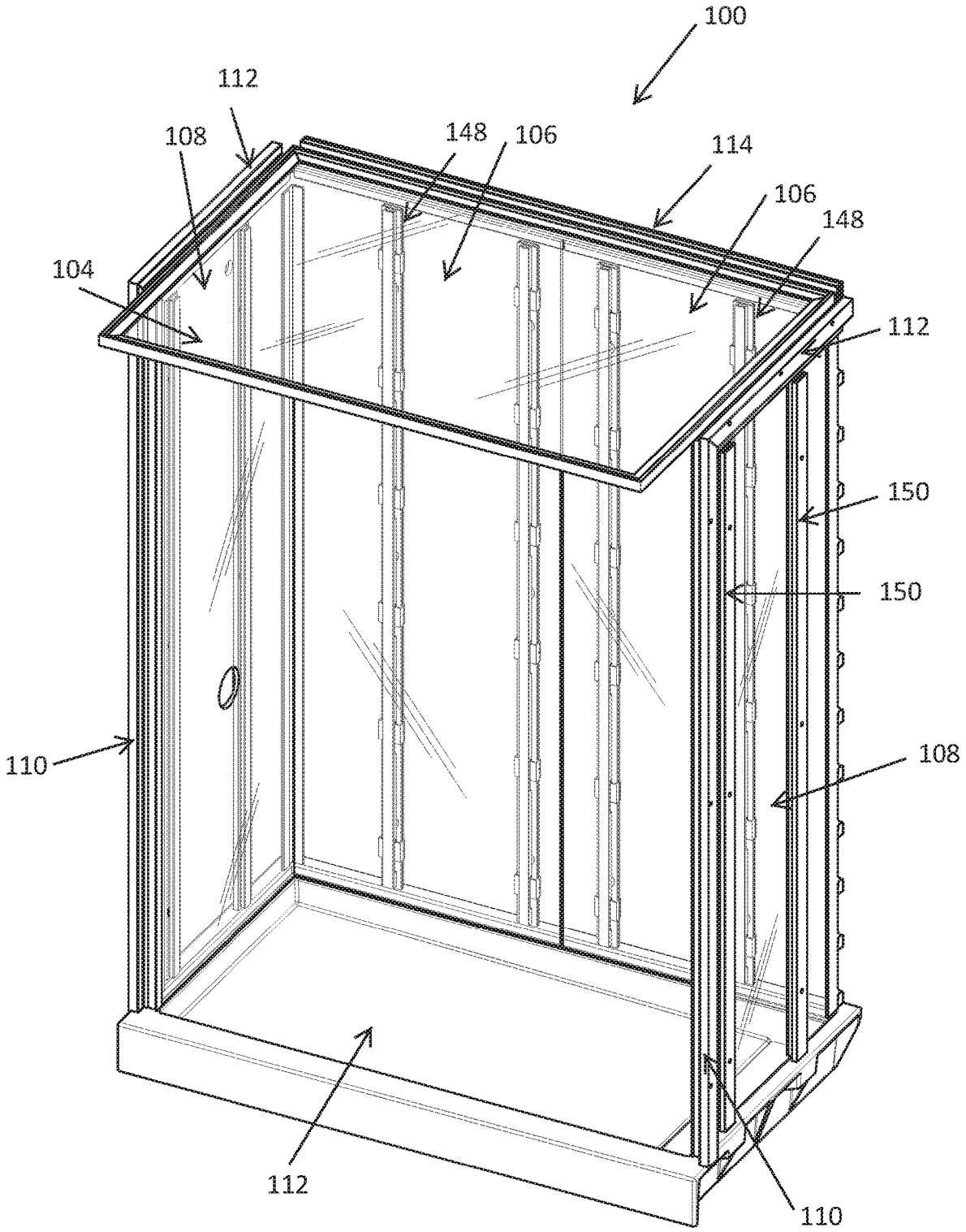
FIG. 1 illustrates a front isometric view of a modular shower enclosure according to some embodiments of the invention.
Figure 2:
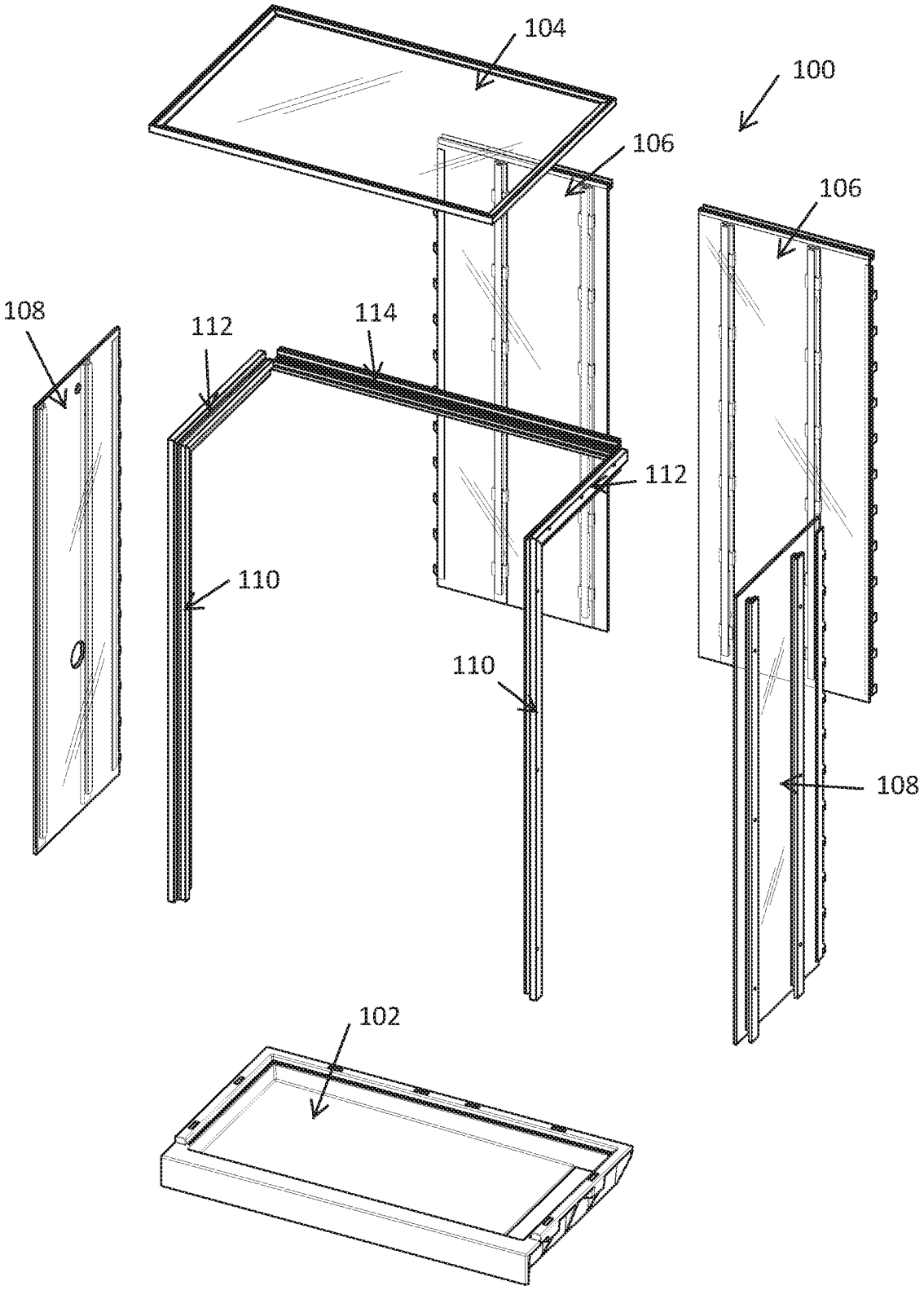
FIG. 2 illustrates an exploded view of the modular shower enclosure of FIG. 1.

FIGS. 1 and 2 illustrate a modular shower enclosure 100 according to some embodiments. The modular shower enclosure 100 of FIGS. 1 and 2 includes a base 102, a lid 104, rear surround panels 106, side surround panels 108, front closure assemblies 110, side closure assemblies 112, and rear closure assembly 114. As will be described more fully below, the modular shower enclosure 100 saves installation time, complexity, expense, and the number of necessary skilled artisans by delivering prefabricated shower components to a job site requiring only simple assembly. The shower enclosure 100 components are prefabricated per a client's specifications and delivered to a job site together as a unit to be assembled by an installation team. The components are customized to the specific job site conditions such that very little adjustment is required on site during installation. The components of the modular shower enclosure 100 are fabricated and cut to size offsite prior to installation at a jobsite, for example in a manufacturing facility. At the jobsite, the installation team performs a shower install without requiring the complexities involved with typical existing shower systems. Unlike existing shower systems, installation of the prefabricated components are performed without requiring measuring and cutting pieces to desired lengths, without requiring expensive and time consuming tiling operations, and without the long delay associated with typical adhesive and cement drying times. The modular shower enclosure of the invention eliminates cutting operations at the jobsite by use of alignment supports and adjustable closure assemblies despite the existence of out of plumb walls or other variances in the building structure. In some embodiments, a two person installation team can assemble the modular shower enclosure 100 in under three hours.

The modular shower enclosure 100 can be installed either during new building construction or as part of a renovation project and can be used in the hospitality industry as well as multifamily housing units. If the project is a building renovation, the existing bath or shower enclosure can be removed and an alcove 103 (not illustrated) can be left for the installation. The alcove 103 can be used as a securing surface for attaching modular shower enclosure 100. The alcove 103 may have walls made of drywall attached to metal or wooden structural studs. If the project is a new building, an alcove 103 can be prepared in the same way. In a new building project having an alcove 103 containing open studs (i.e., without outer walls made of drywall connected to the studs), strips of material may be fastened onto the studs to form a securing surface for attaching the modular shower enclosure 100. In some embodiments, the strips of material can be made of plywood, gypsum board, or other wall panel products known in the art. In some embodiments, the interior space of the alcove 103 can be 60 inches by 36 inches.

Figure 3:
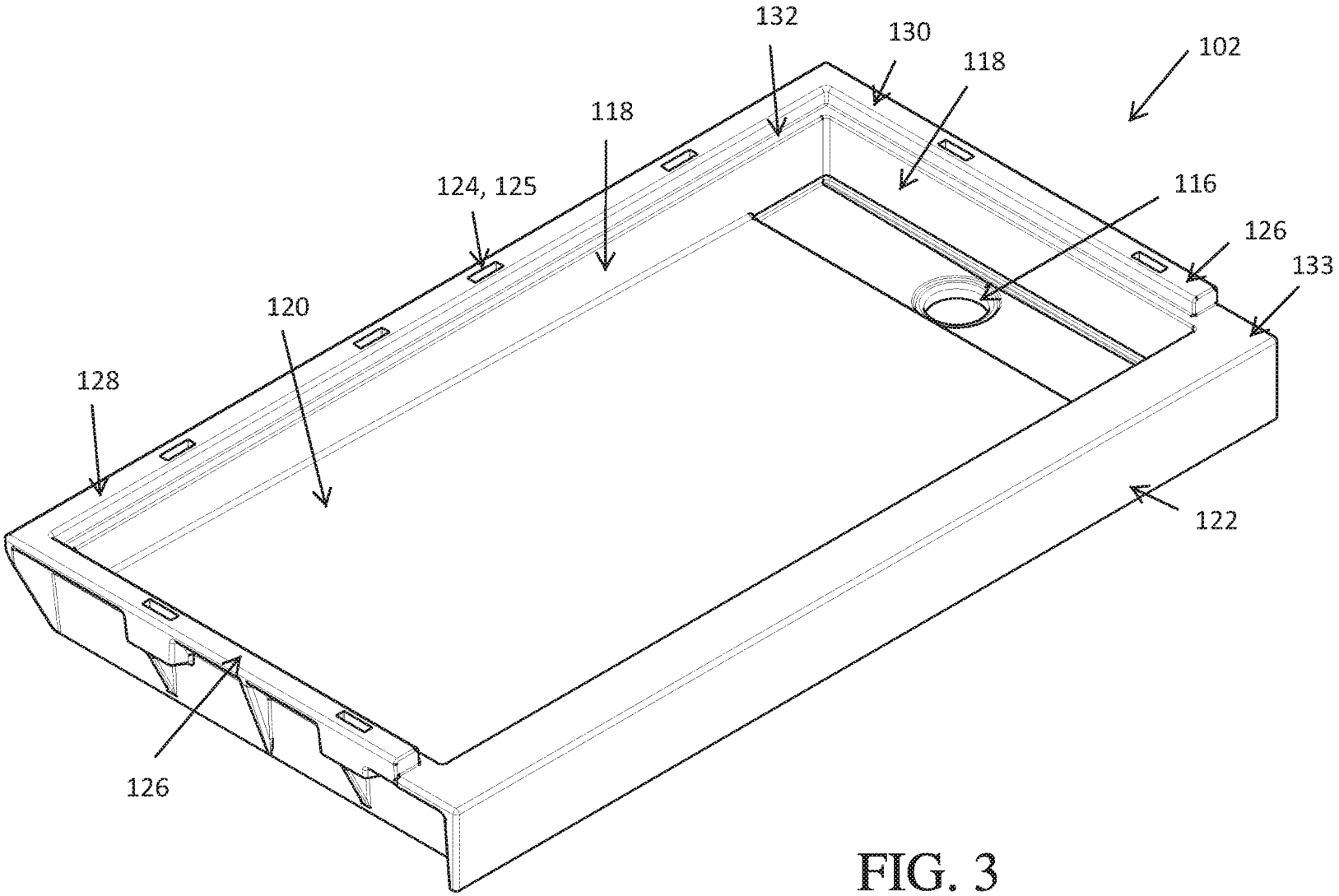
FIG. 3 illustrates a front isometric view of a base of a modular shower enclosure according to some embodiments of the invention.
Figure 4:
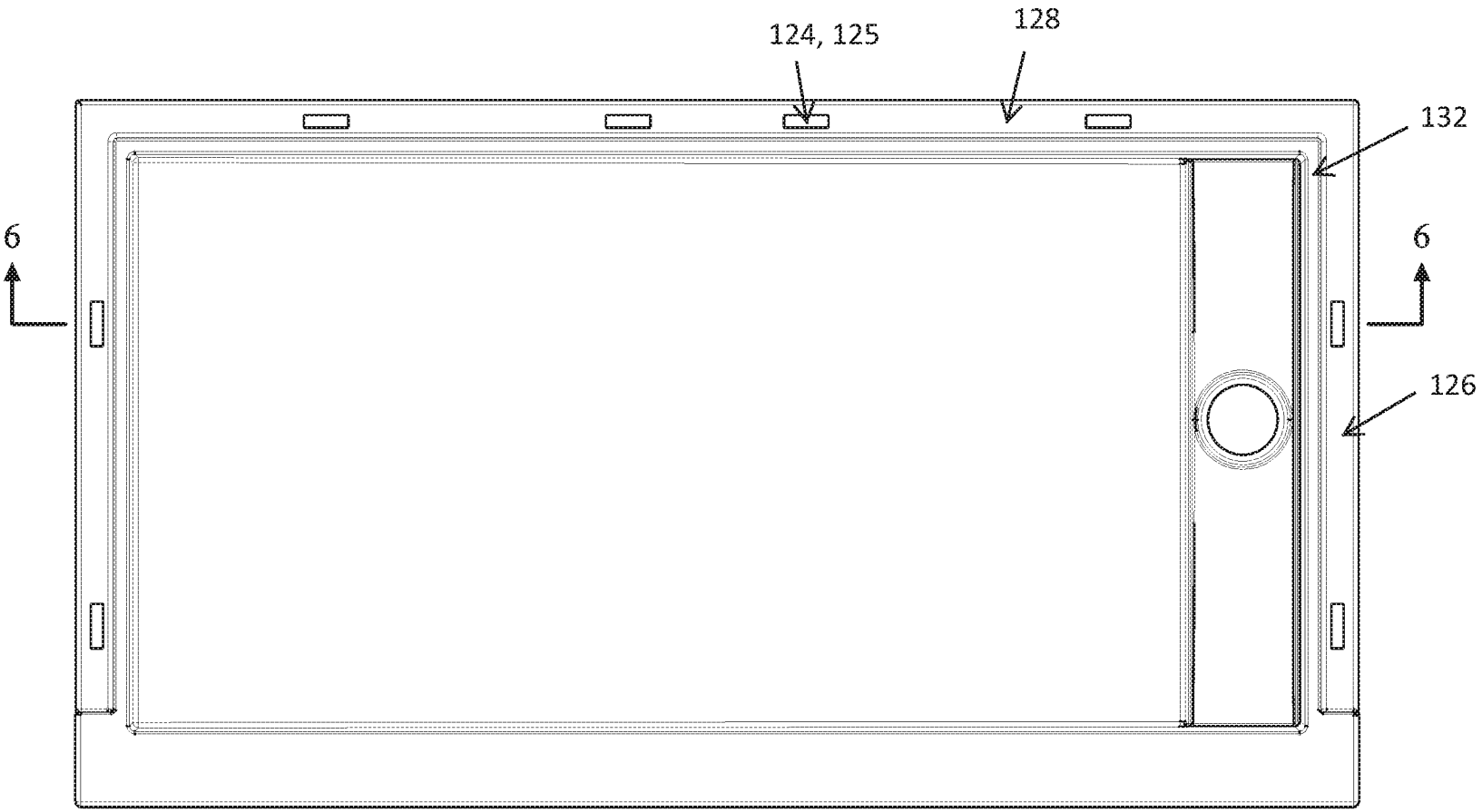
FIG. 4 illustrates a top view of the base of FIG. 3.
Figure 5:
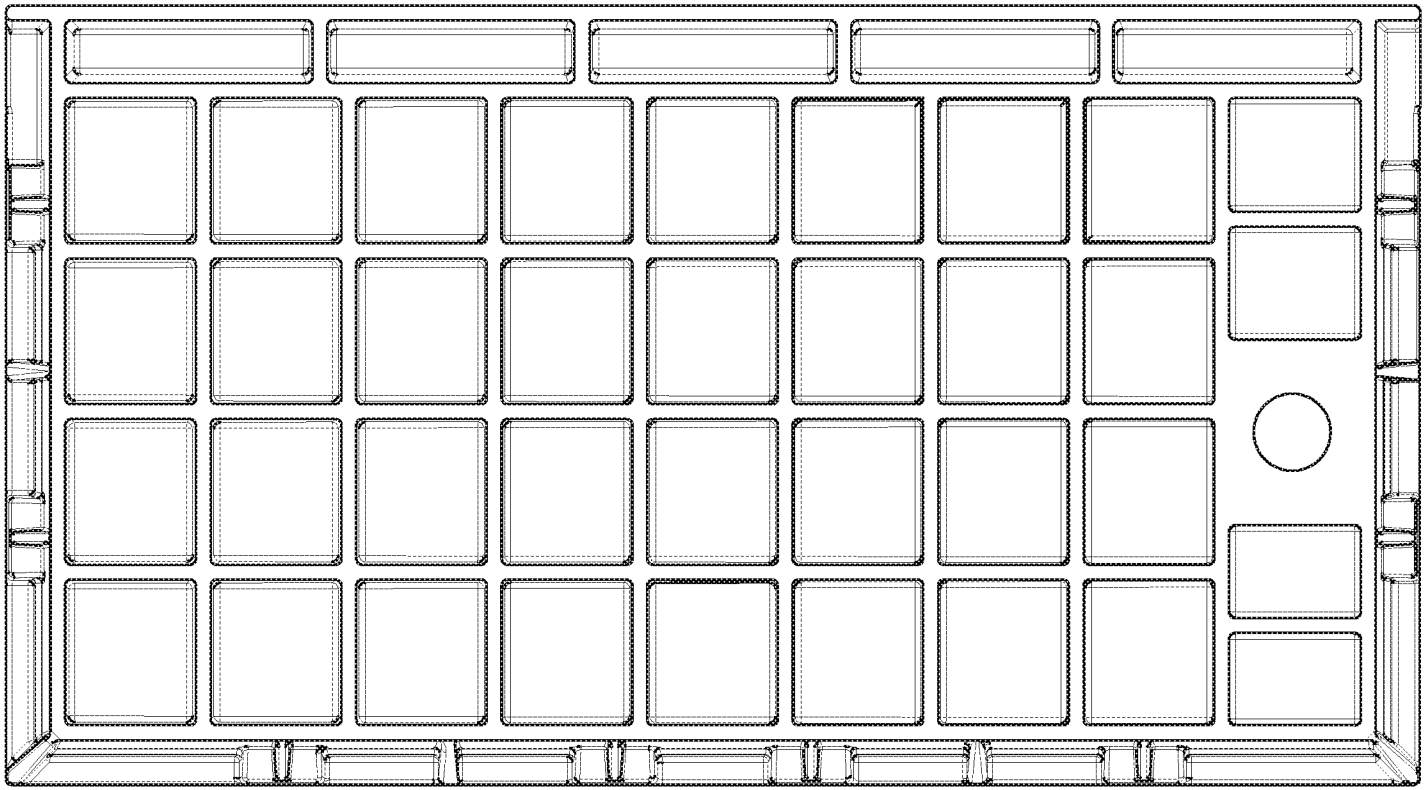
FIG. 5 illustrates a bottom view of the base of FIG. 3.
Figure 6:
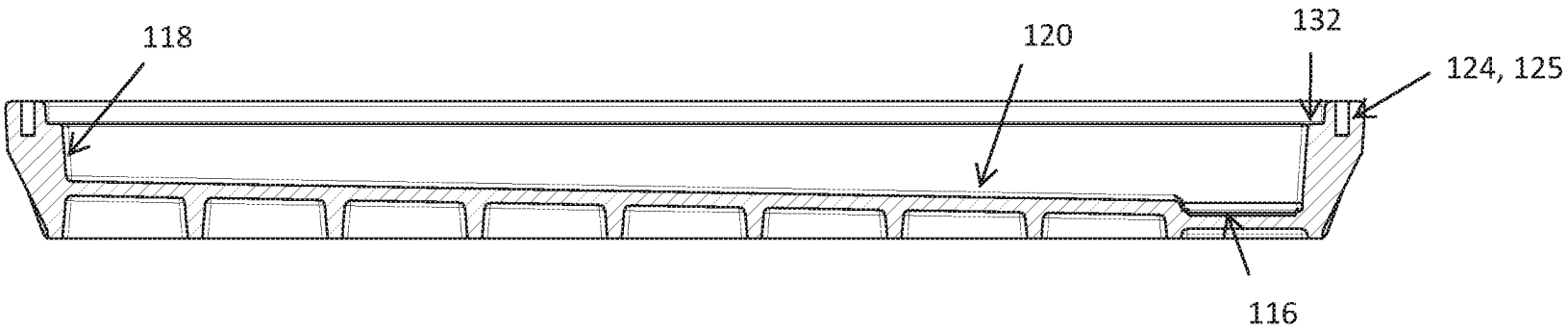
FIG. 6 illustrates a cross-sectional view of the base of FIG. 4, the cross section taken along the line 6-6.

FIGS. 3 to 6 illustrate a base 102 of the modular shower enclosure 100. After the alcove 103 has been prepared, in some embodiments, the first part of the installation procedure of the modular shower enclosure 100 is to install the base. In some embodiments, the base 102 can be a shower pan. The base 102 may be placed in layer of thin set adhesive material to accommodate for any leveling issues with the existing floor and prevent the base 102 from moving. The base 102 can be a single unit, such as a body of solid surface material formed in a mold. The base 102 can be fabricated in a factory to a desired size and delivered to the job site with the other shower components ready for installation. In some embodiments, the base 102 has a nominal size of approximately 60 inches by 32 inches and is designed to fit into a 60 inch by 36 inch alcove 103 as described above. The base 102 can act as a waterproof drainage catchment for the shower. The base includes a pre-cut drain hole 116, which can connect to a traditional waste water drainage pipe (not shown). As shown in FIGS. 3 and 6, the base 102 has sidewalls 118, a sloped floor 120 to direct water to the drain hole 116, and a front threshold 122 that forms a curb to keep water from running out of the base. In some embodiments, the sloped floor 120 can have a 1 degree slope in a direction toward the drain hole 116. The base 102 can be produced in a variety of colors for aesthetic versatility.

Figure 11:
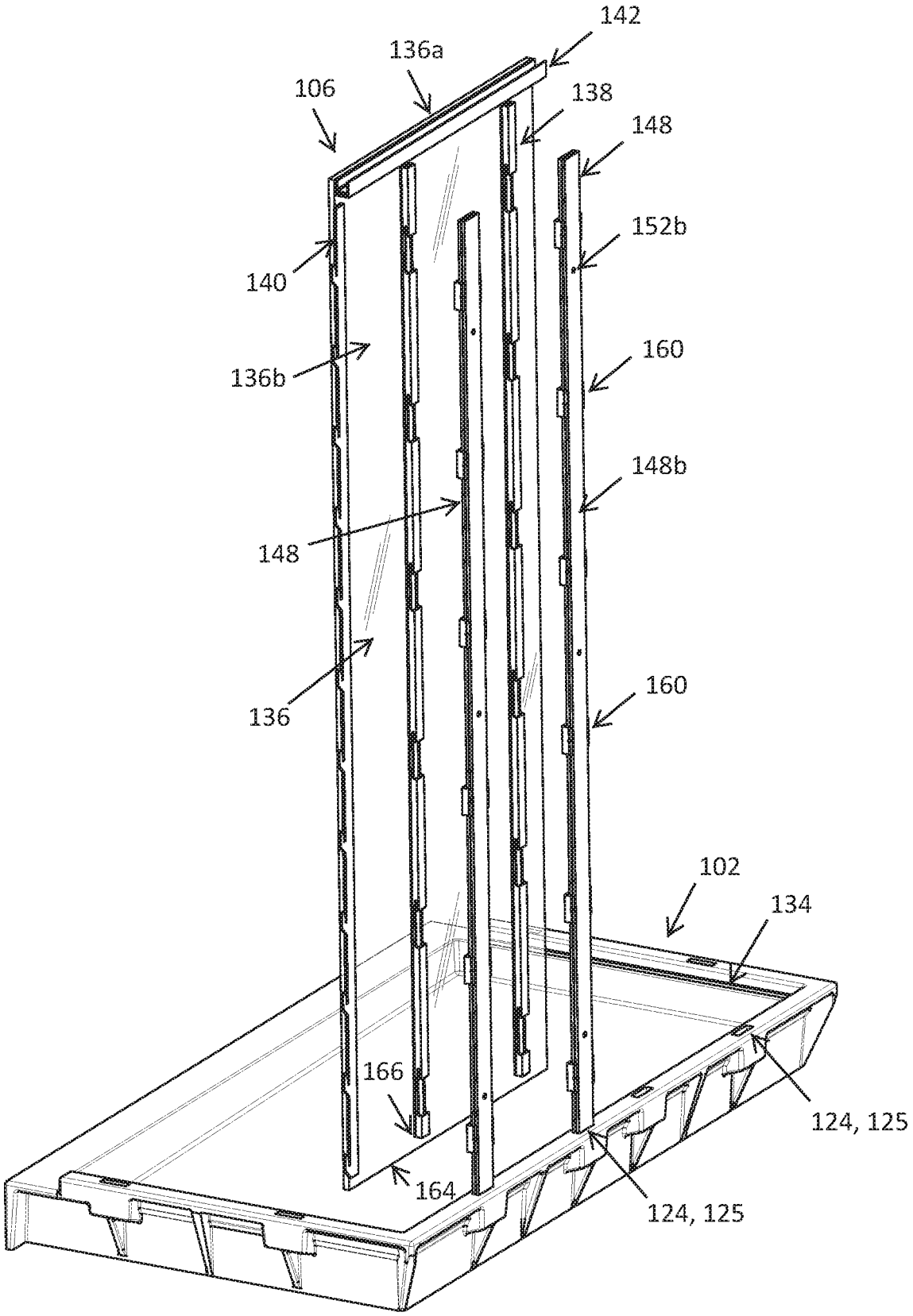
FIG. 11 illustrates a partial assembly of a modular shower enclosure according to some embodiments of the invention.

The base 102 can serve as an organizing template for the surround panels 106, 108 and the front closure assemblies 110. In some embodiments, the base 102 can have a plurality of spaced apart engagement features 124 for mounting or orienting the surround panels 106, 108. In some embodiments, the alignment supports 148, 150 are positionable in a preselected relationship relative to engagement features 124 of the base 102. As will be described in more detail below, the alignment supports 148, 150 in some embodiments can be positioned in a preselected "square" position relative to the base 102 to provide precisely vertical mounting surfaces that accommodate for alcove 103 walls that are out of plumb. In some embodiments, the engagement features 124 are slots 125 for receiving corresponding alignment supports 148, 150 to attach to surround panels 106, 108 (see FIG. 11). The engagement features 124 can be located on side walls 126 and a rear wall 128 of the base 102 and can be formed on an upper surface 130 of the side walls 126 and the rear wall 128. The slots 125 can be blind holes formed in the upper surface 130. In some embodiments, the slots 125 have a rectangular cross section and can be 1 to 2 inches deep. In some embodiments, the slots 125 are 1.5 inches deep. The cross section of the slots 125 can be designed to mate with a corresponding cross section of the alignment supports 148, 150 as shown in FIG. 11. In the embodiment shown in FIG. 3, the base 102 has two slots 125 on each of the side walls 126 and four slots on the rear wall 128 of the base 102. It should be appreciated that the number of slots 125 can differ, for example one to three slots on each of the side walls 126 and two to six slots on the rear wall 128. In some embodiments, the engagement features 124 can be raised protrusions extending from the upper surface 130. In some embodiments, the engagement features 124 can be threaded fasteners or any other structure suitable for engagement with the alignment supports 148, 150. The side walls 126 and the rear wall 128 of the base 102 can have a lip 132 to receive surround panels 106, 108. In some embodiments, the lip 132 can be sized to receive surround panels 106, 108 that are up to 0.5 inches thick. The lip 132 can be 1 inch tall in some embodiments. The lip 132 can be lined with a liner 134 (see FIG. 11) that is situated between the material of the base 102 and the surround panels 106, 108. The liner 134 may be adhered to the lip 132 by an adhesive member and/or by mechanical fasteners.

Figure 21C:
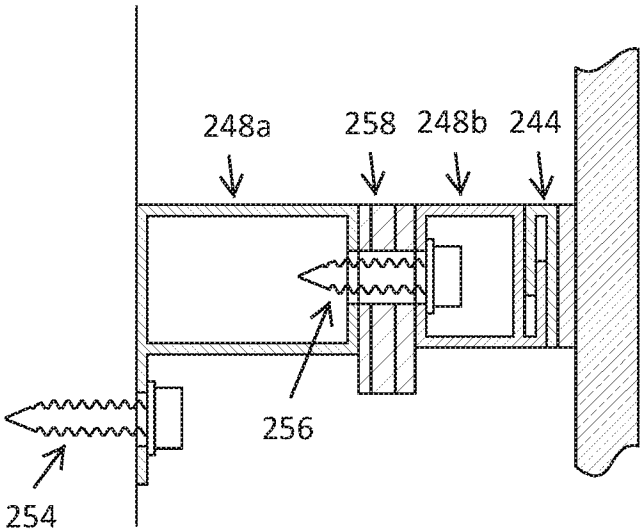
FIGS. 21A-21C illustrate alignment supports according to some embodiments of the invention.
Figure 21B:
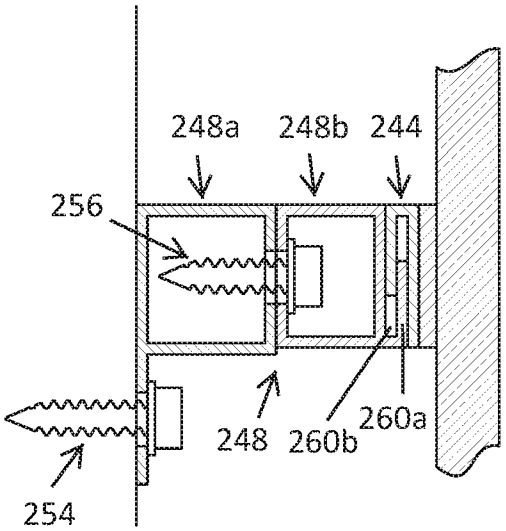
Figure 21A:
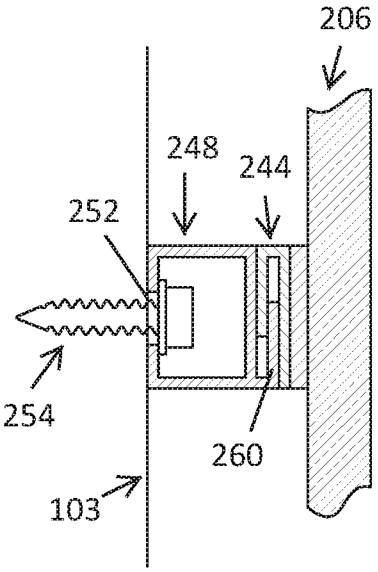

After the base 102 is installed, alignment supports 148, 150 can be installed (see FIGS. 11-13 and 15-16). Rear alignment supports 148 can be metal support members that connect to the rear surround panels 106. In some embodiments, the rear alignment supports 148 are used to mount the rear surround panels 106 to the shower enclosure 100 and to mount the rear surround panels 106 to the building alcove 103. Side alignment supports 150 can be metal support members that connect to the side surround panels 108. In some embodiments, the side alignment supports 150 are used to mount the side surround panels 108 to the shower enclosure 100 and to mount the side surround panels 108 to the building alcove 103. In some embodiments, the alignment supports 148, 150 can be substantially vertically extending elongate supports. In some embodiments, the alignment supports 248 can be substantially horizontally extending elongate supports as shown in FIGS. 21A-21C. The alignment supports 148, 150 can be fabricated in a factory to the desired size and delivered to the job site with the other shower components ready for installation. The alignment supports 148, 150 can be made of extruded aluminum. The alignment supports 148, 150 have a front side 148*a*, 150*a* that faces the interior of the shower enclosure 100 and a back side 148*b*, 150*b* that faces the alcove 103 (i.e., away from the interior of the shower enclosure 100).

Figure 14:
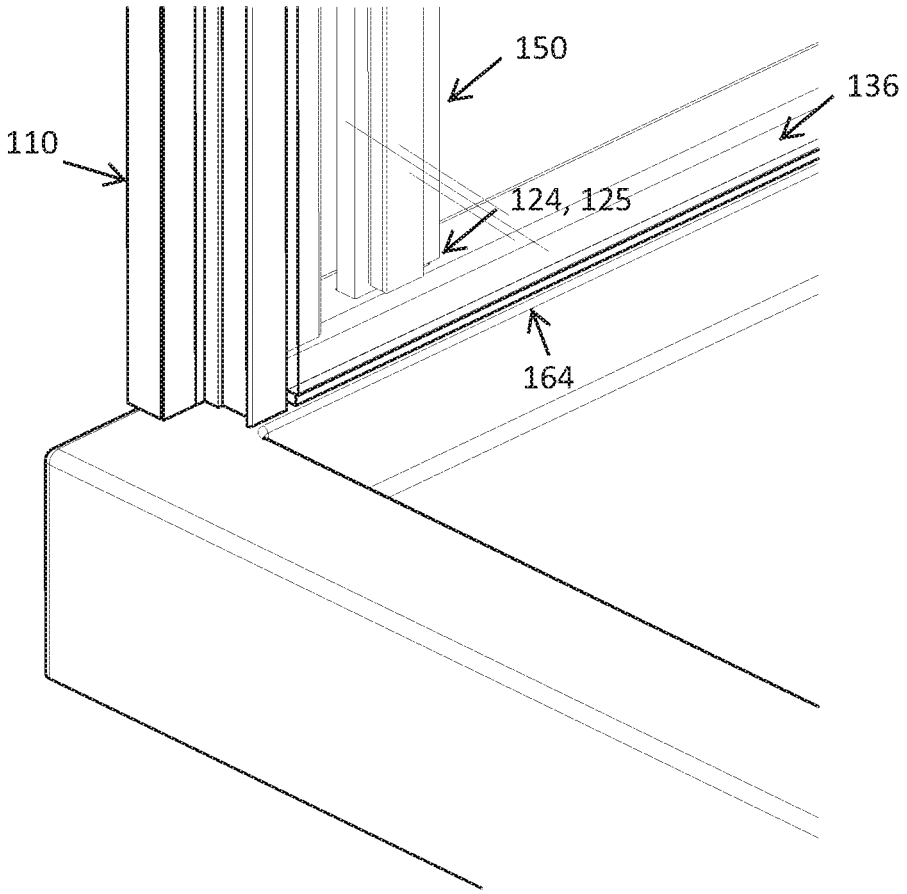
FIG. 14 illustrates a partial isometric view of a front corner of a modular shower enclosure according to some embodiments of the invention.

In some embodiments, to install the alignment supports 148, 150, lower portions of the alignment supports 148, 150 are mated with the engagement features 124 of the base 102. In some embodiments where the engagement features 124 have slots 125, the cross section of alignment supports 148, 150 can be sized to be received in the slots 125 of the base 102 as shown in FIGS. 11 and 14. When the slots 125 have rectangular cross sections, the cross sections of lower portions of the alignment supports 148, 150 can have corresponding rectangular cross sections sized to be received in the slots 125. In some embodiments, the alignment supports 148, 150 have uniform cross sections. The width of the alignment supports 148, 150 can be narrower than the width of the slots 125 to provide side to side adjustment of the alignment supports 148, 150 in the slots 125 upon insertion.

Figure 12:
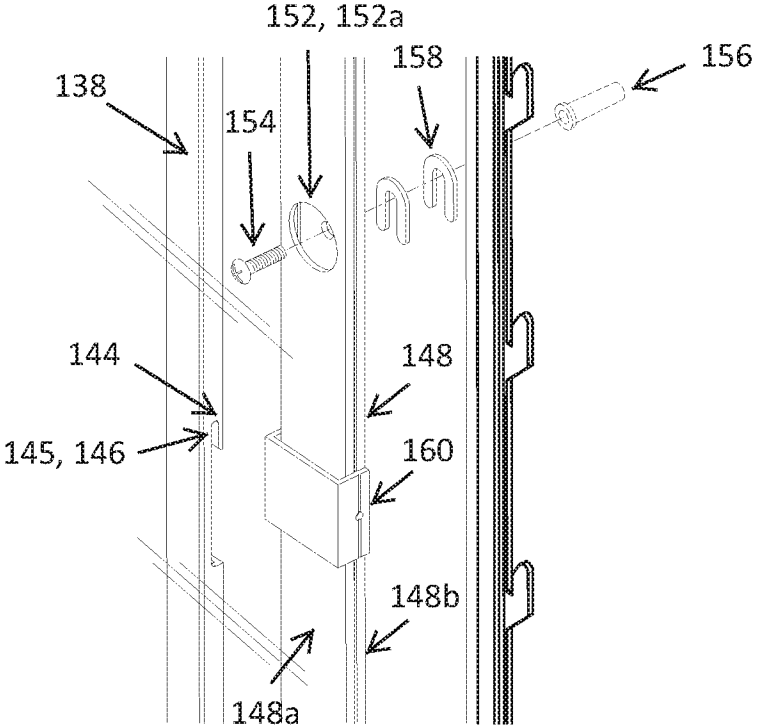
FIG. 12 illustrates an exploded view of a rear surround panel and rear alignment support according to some embodiments of the invention.

After mating with the base 102, the alignment supports 148, 150 are attached to the building alcove 103 (see FIG. 12). The alignment supports 148, 150 can have a plurality of vertically spaced through holes 152 which can be used to connect the alignment supports 148, 150 to the alcove 103 via fasteners 154. When inserted, the fasteners 154 can be flush or recessed with respect to the front side 148*a*, 150*a* of the alignment supports. In some embodiments, the fasteners 154 may be dry wall screws, wood screws, and/or metal screws. In the case of alcove 103 walls that have drywall, drywall anchors 156 may be used to anchor the alignment supports 148, 150 to the alcove 103.

Because of variances in the construction of wood and metal framed buildings, the building alcove 103 may have walls that are out of plumb (e.g., walls that are not precisely "square" or vertical). Shims 158 can be used to ensure that the alignment supports 148, 150 are precisely "square" with the configuration of the base 102 despite any deviations that might exist in the wall itself (see FIG. 12). The shims 158 can be used at the back side 148*b*, 150*b* of the alignment supports 148, 150 between the alcove 103 and the alignment supports 148, 150. In some embodiments, the alignment supports 148, 150 are designed to accommodate a wall that is ±1.5 inches out of plumb. Each alignment support 148, 150 can be independently adjusted to a precisely "square" or level condition relative to the configuration of the base 102. It should be appreciated that multiple shims 158 can be used to plumb the alignment supports 148, 150. At some locations of the alignment supports 148, 150, either zero or one shim 158 may be used while in other locations, multiple shims 158 may be required to accommodate a wall significantly out of plumb.

Figure 13:
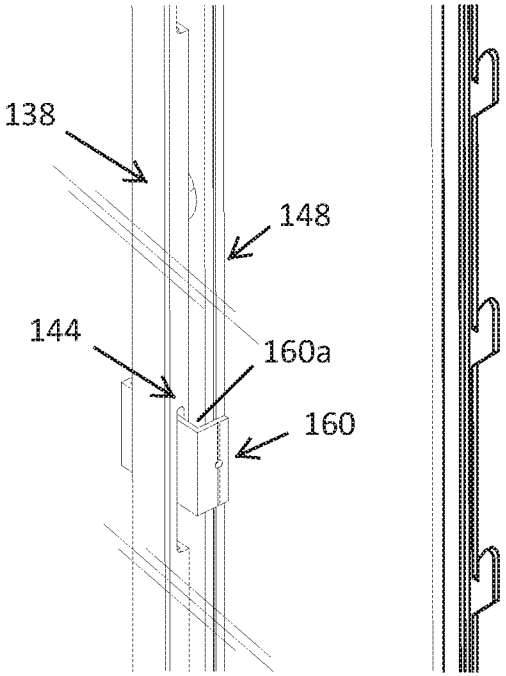
FIG. 13 illustrates an assembled view of the rear surround panel and rear alignment support according to FIG. 12.

The alignment supports 148, 150 provide plumb mounting surfaces to attach the surround panels 106, 108. As shown in FIGS. 12 and 13, the rear alignment supports 148 can include coupling mounts 160 for attaching the rear surround panels 106 to the shower enclosure 100. The coupling mounts 160 are provided on the front side 148*a* of rear alignment supports 148 and face the rear surround panels 106. In some embodiments, the coupling mounts 160 have a u-shaped cross-section in a direction perpendicular to a vertical length of the coupling portions rear alignment supports 148. A channel or opening 160*a* can be formed behind the coupling mounts 160. In some embodiments, the coupling mounts 160 of the rear alignment supports 148 can vertically receive coupling portions 144 of the rear surround panels 106, as more fully described below. The coupling mounts 160 may be of a single piece construction with the rear alignment supports 148 (e.g., a single extruded aluminum piece), or may be a separate component attached to the rear alignment supports 148 (e.g., by fasteners and/or adhesive).

Figure 16:
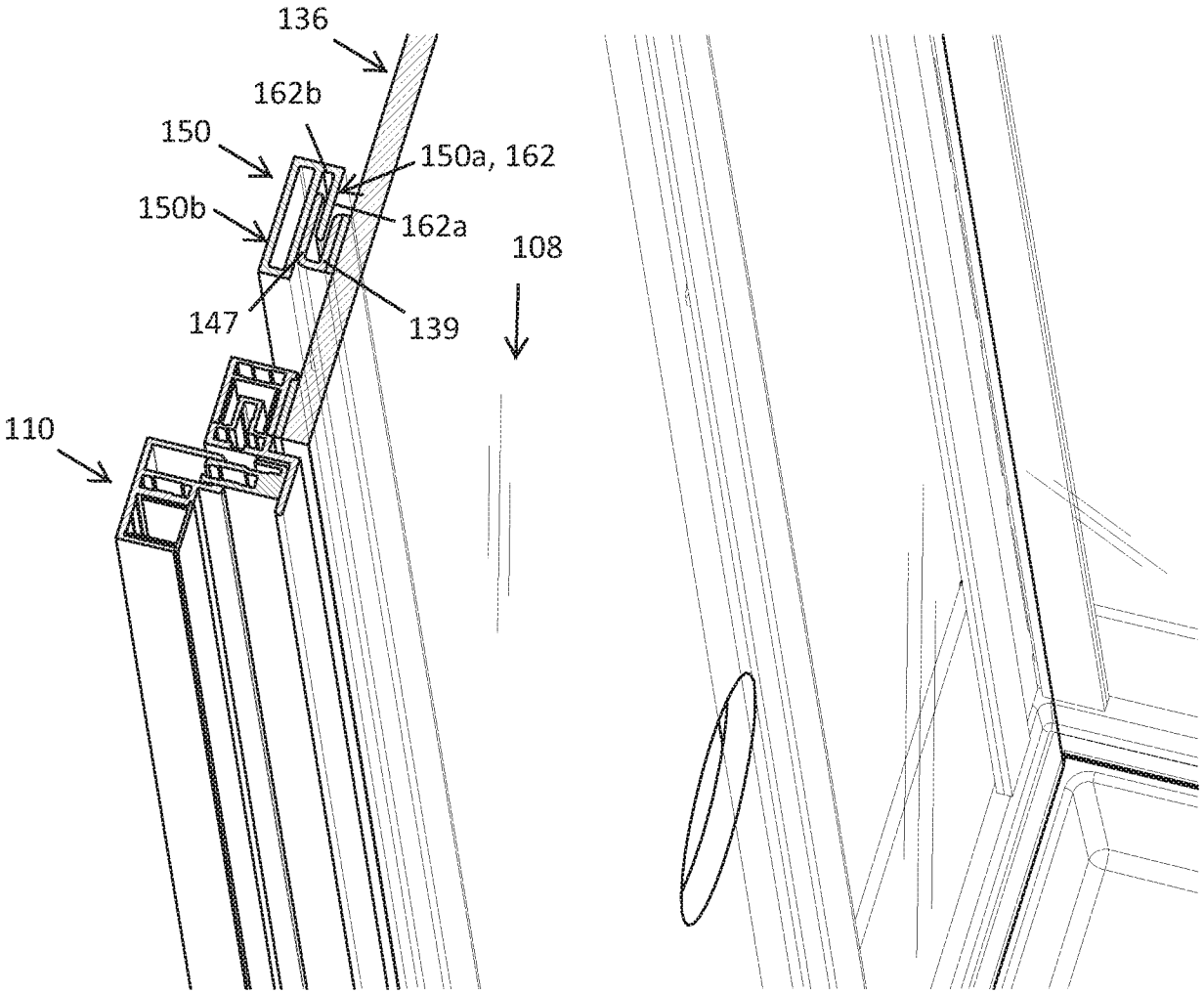
FIG. 16 illustrates a side surround panel and front closure assembly according to some embodiments of the invention.

As shown in FIG. 16, the side alignment supports 150 can include coupling mounts 162 for attaching the side surround panels 108 to the shower enclosure 100. The coupling mounts 162 are provided on the front side 150*a* of side alignment supports 150 and face the side surround panels 108. The coupling mounts 162 of the side alignment supports 150 can include a flange 162*a* that extends along a vertical length of the slide alignment supports 150. The coupling mounts 162 can include a vertically extending channel 162*b* behind the flange 162*a* that is open on one side. In some embodiments, the coupling mounts 162 can horizontally receive coupling portions 147 of the side surround panels 108, as more fully described below. The coupling mounts 162 may be of a single piece construction with the side alignment supports 150 (e.g., a single extruded aluminum piece), or may be a separate component attached to the side alignment supports 150 (e.g., by fasteners and/or adhesive).

FIGS. 7 to 10 illustrate rear surround panels 106 and side surround panels 108 according to some embodiments of the present invention. Following installation of the alignment supports 148, 150, surround panels 106, 108 can be installed.

Figure 7:
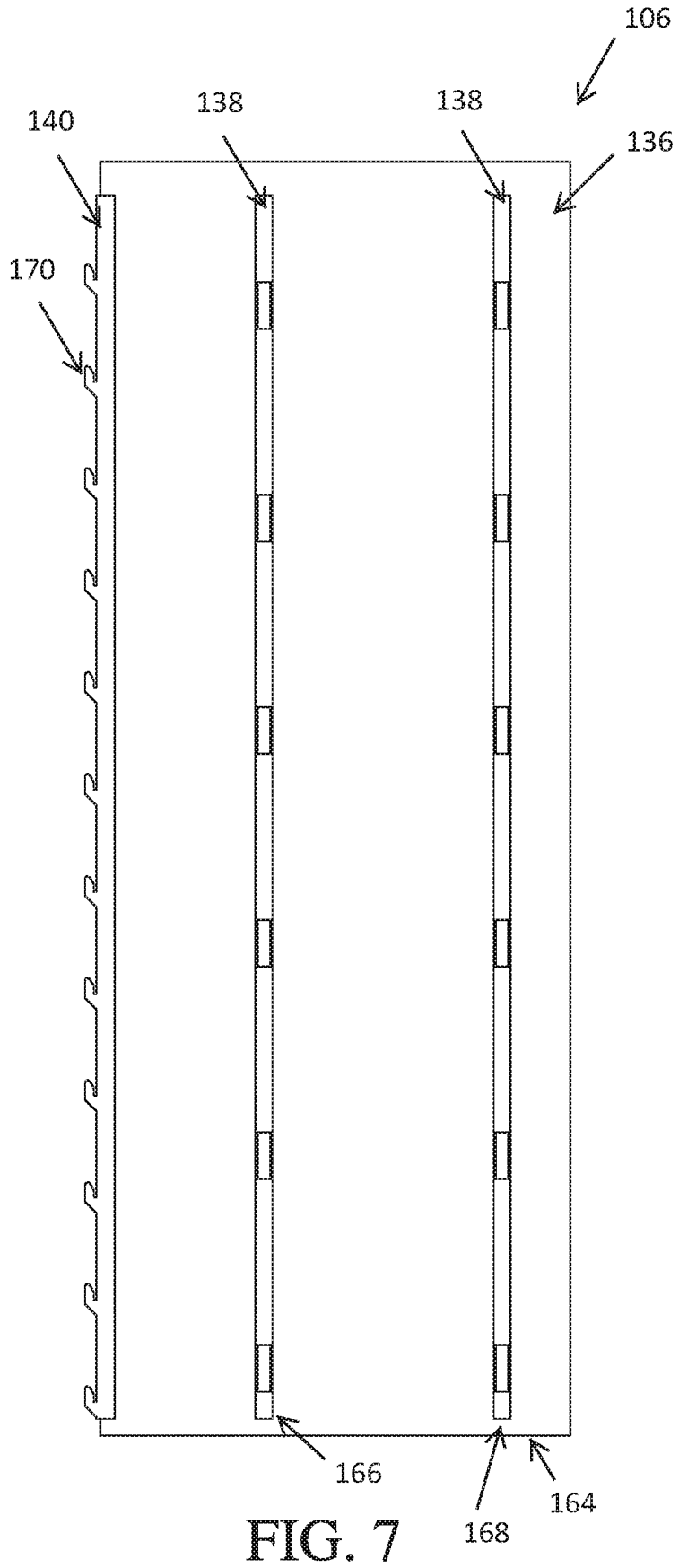
FIG. 7 illustrates a side view of a rear surround panel of the modular shower enclosure according to some embodiments of the invention.
Figure 8:
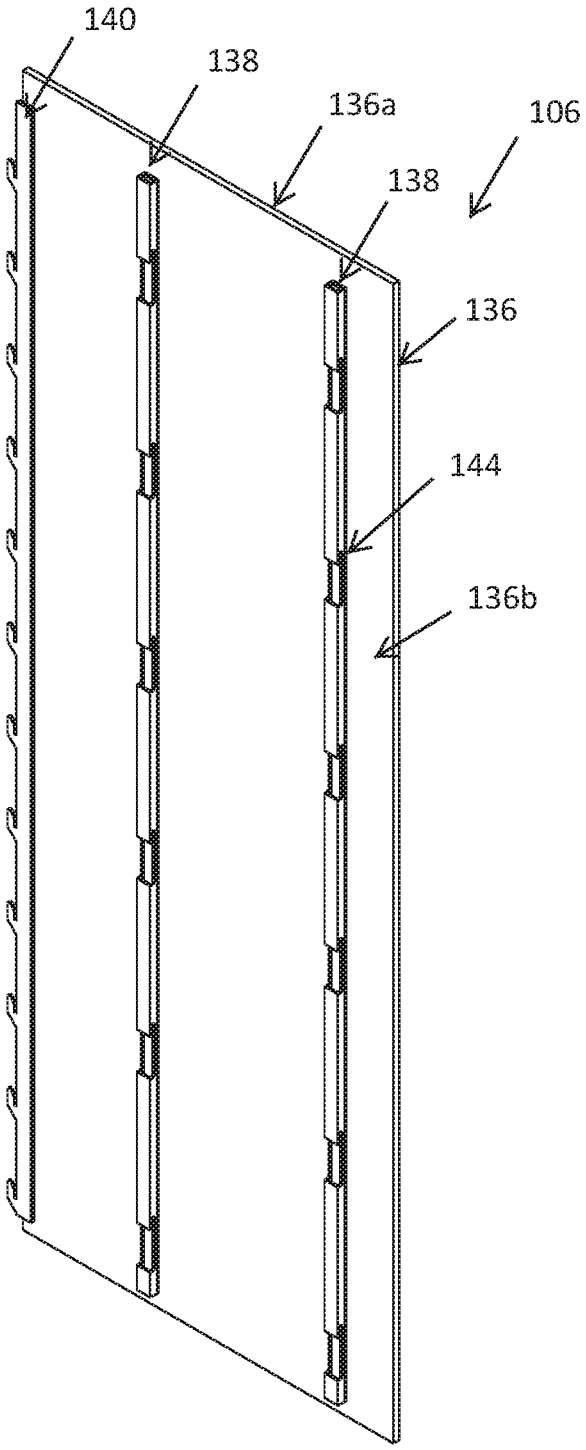
FIG. 8 illustrates an isometric view of the rear surround panel of FIG. 7.

FIGS. 7, 8, and 11 illustrate a rear surround panel 106 according to some embodiments. The rear surround panels 106 can be fabricated in a factory to the desired size and delivered to the job site with the other shower components ready for installation. The rear surround panels 106 can include a panel sheet 136 with a front side 136*a* and a back side 136*b*. Upon installation, the front side 136*a* of the panel sheet 136 faces the interior of the shower and provides a decorative finish. The back side 136*b* of the panel sheet 136 faces the building alcove 103 (i.e., faces away from the interior of the shower). Because the rear surround panels 106 are prefabricated, they can be made out of materials that cannot be cut to size on the job site, such as glass. The panel sheet 136 may be offered in a range of styles and materials per customer preferences, including decorative glass, engineered stone, solid surface materials, porcelain, and fine art glass. Holes in panel sheet 136 that are required for plumbing and the connection of outlets, faucets, shower heads and other fixtures like rail bars, soap dishes, and foot rests may be pre-cut in a factory. In some embodiments, the surround panels 106, 108 can be changed without replacing the entire shower enclosure 100.

The rear surround panels 106 can include rear mounting rails 138 as shown in FIGS. 8 and 11. The rear mounting rails 138 are used to connect the rear surround panels 106 to the shower enclosure 100. The rear mounting rails 138 can extend vertically along the panel sheet 136 and are rigidly attached or affixed to the back side 136*b* of the panel sheet 136. The rear mounting rails 138 can be fabricated out of extruded aluminum and can be installed to the panel sheet 136 at a factory. In some embodiments, the rear mounting rails 138 can be attached to the panel sheet 136 by an adhesive member. In some embodiments, the rear mounting rails 138 are attached to the panel sheet 136 by silicone tape, such as double-sided high strength bonding tape. In some embodiments, the silicone tape may be VHB™ tape manufactured by 3M™. In some embodiments, the rear mounting rails 138 may be attached to the panel sheet 136 by mechanical fasteners.

The rear mounting rails 138 are installed on the rear surround panels 106 at a factory to provide alignment with the rear alignment supports 148 during assembly on the jobsite. As shown in FIGS. 12 and 13, the rear mounting rails 138 include coupling portions 144 to couple to the rear alignment supports 148. The coupling portions 144 can be shaped as downward extending protrusions or projections 145 having a recess 146 with a closed end portion, the recess 146 located behind the protrusion 145. The protrusions 145 are designed to be vertically received by the coupling mounts 160 of the rear alignment supports 148. Thus, the coupling portions 144 of the rear surround panels 106 are configured to engage the coupling mounts 160 of the rear alignment supports 148 by downward movement of the rear surround panel 106 relative to the rear alignment supports 148. During assembly, the rear surround panels 106 may be lifted and dropped into engagement with the rear alignment supports 148. In particular, the protrusions 145 of the rear surround panels 106 may be vertically dropped into engagement with the coupling mounts 160 of the rear alignment supports 148. Once assembled, the protrusions 145 may be situated in the channel 160*a*. As shown in FIG. 13, the protrusions 145 may be received in the coupling mounts 160 without bottoming out the recess 146. As shown in FIGS. 7 and 11, a lower edge 164 of the panel sheet 136 extends below a lower edge 166 of the rear mounting rails 138 forming a gap 168. In some embodiments, the height of the gap 168 can be dimensioned such that when installed, the lower edge 164 of the panel sheet 136 can abut against the lip 132 of the base 102 or liner 134 and prevent the protrusions 145 from bottoming out in the coupling mounts 160. As such, the dead load of the rear surround panel 106 can be supported by the base 102 and not by the coupling mounts 160. As shown in FIGS. 12 and 13, the width of the coupling mounts 160 of the rear alignment supports 148 may be wider than the coupling portions 144 of the rear surround panels 106 to provide side to side adjustability.

Figure 15:
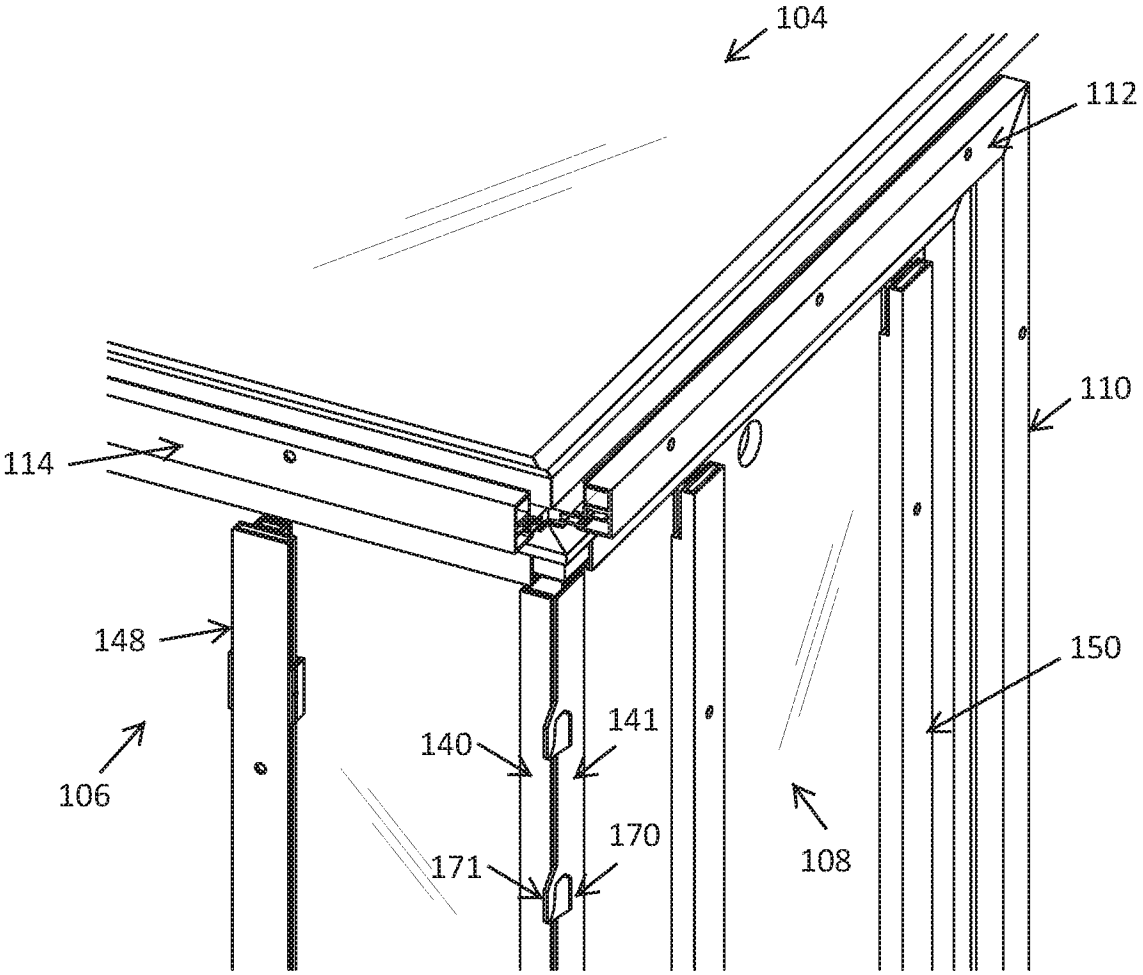
FIG. 15 illustrates a partial rear isometric view of a modular shower enclosure according to some embodiments of the invention.

The rear surround panels 106 can additionally include interlocking rails 140 as shown in FIGS. 7, 8, and 15. The interlocking rails 140 are located on vertical edges of the rear surround panel 106 to connect the surround panels 106, 108 at rear corners of the shower enclosure 100. As shown in FIG. 15, the interlocking rails 140 are used to connect a rear surround panel 106 to an adjacent side surround panel 108. The interlocking rails 140 can include engagements 170 which engage corresponding engagements 171 of interlocking rails 141 of a side surround panel 108. The interlocking rails 140 and the engagements 170 can have a substantially planar shape. In some embodiments, the engagements 170 can have the shape of upward or downward facing protrusions. In some embodiments, the engagements 170 can have a finger-like shape. In some embodiments, the engagements 170 can have the shape of interlocking teeth. The interlocking rails 140 are rigidly attached to the back side 136*b* of the panel sheet 136. The interlocking rails 140 can be fabricated out of extruded aluminum and can be installed at a factory to the panel sheet 136.

In some embodiments, multiple rear surround panels 106 may be used, for example two side by side rear surround panels 106 (see FIGS. 1 and 2). In some embodiments where two rear surround panels 106 are used, each panel may have a nominal size of 30 inches wide by 96 inches tall. When multiple rear surround panels 106 are used, a sealant may be placed in a jam between the panels to provide a water tight seal. In some embodiments, a single rear surround panel 106 may be used. The single rear surround panel 106 may have a nominal size of 60 inches wide by 96 inches tall. The single rear surround panel 106 may have interlocking rails 140 at left and right vertical edges of the panel sheet 136.

Figure 9:
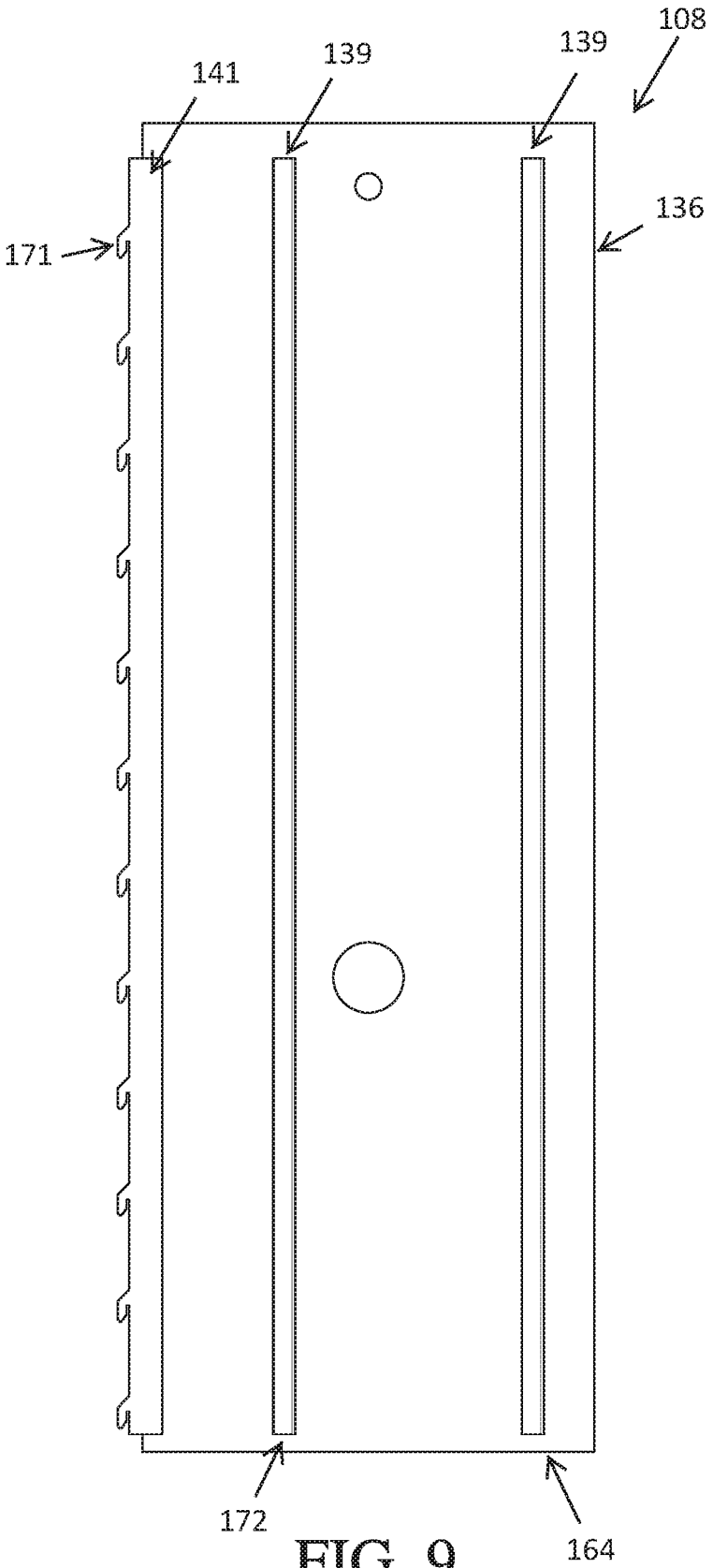
FIG. 9 illustrates a side view of a side surround panel of the modular shower enclosure according to some embodiments of the invention.
Figure 10:
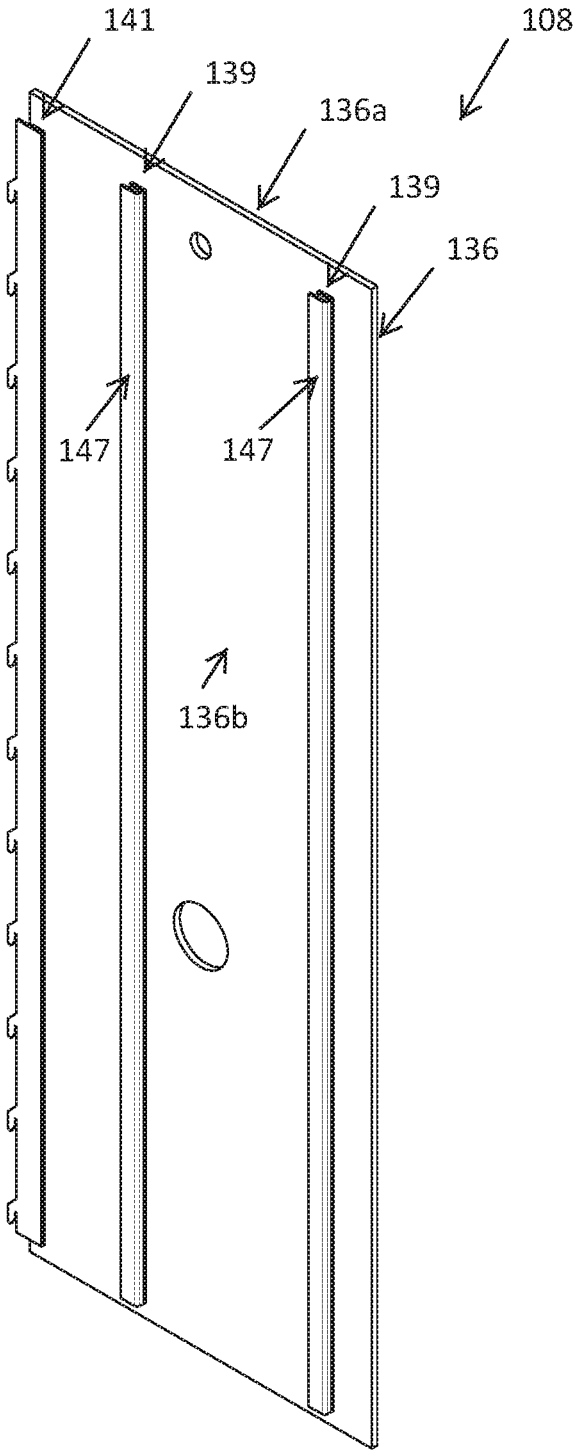
FIG. 10 illustrates an isometric view of the side surround panel of FIG. 9.

FIGS. 9 and 10 illustrate a side surround panel 108 according to some embodiments. The side surround panels 108 can be fabricated in a factory to the desired size and delivered to the job site with the other shower components ready for installation. Each side surround panel 108 may have a nominal size of 32 inches wide by 96 inches tall. The side surround panels 108 can include a panel sheet 136. The panel sheets 136 of the side surround panels 108 are similar to those of the rear surround panels 106 and the description thereof will not be repeated. The panel sheets 136 of the side surround panels 108 and the rear surround panels 106 can be fabricated using the same process and can have the same materials. In some embodiments, the panel sheets 136 of the side surround panels 108 and the rear surround panels 106 can have different materials.

The side surround panels 108 can include side mounting rails 139 as shown in FIGS. 10 and 16. The side mounting rails 139 are used to connect the side surround panels 108 to the shower enclosure 100. The side mounting rails 139 can extend vertically along the panel sheet 136 and are rigidly attached to the back side 136*b* of the panel sheet 136. The side mounting rails 139 can be fabricated out of the same materials as the rear mounting rails 138 of the rear surround panels 106 and can be attached to the panel sheet 136 of the side surround panels 108 in the same manner.

The side mounting rails 139 are installed on the side surround panels 108 at a factory to provide alignment with the side alignment supports 150 during assembly on the jobsite. As shown in FIGS. 10 and 16, the side mounting rails 139 include coupling portions 147 to couple to the side alignment supports 150. The coupling portions 147 can be shaped as a lengthwise flange forming an effective projection extending in a horizontal direction. The flange is designed to be horizontally received by the coupling mounts 162 of the side alignment supports 150 (see FIG. 16). During assembly, the side surround panels 108 may be slid into engagement with the side alignment supports 150. In particular, the flange of the coupling portions 147 of the side surround panels 108 may be horizontally slid into engagement with the coupling mounts 162 of the side alignment supports 150. As shown in FIGS. 9 and 14, a lower edge 164 of the panel sheet 136 extends below a lower edge 172 of the side mounting rails 139 forming a gap. In some embodiments, the height of the gap can be dimensioned such that when installed, the lower edge 164 of the panel sheet 136 can abut against the lip 132 of the base 102 or liner 134. As such, the dead load of the rear surround panel 106 can be supported by the base 102.

The side surround panels 108 can additionally include interlocking rails 141 as shown in FIGS. 9, 10, and 15. The interlocking rails 141 are located on vertical edges of the side surround panel 108 to connect the surround panels 106, 108 at rear corners of the shower enclosure 100. As shown in FIG. 15, the interlocking rails 141 are used to connect a side surround panel 108 to an adjacent rear surround panel 106. The interlocking rails 141 can include engagements 171 which engage corresponding engagements 170 of interlocking rails 140 of a rear surround panel 106. The interlocking rails 141 and the engagements 171 can have a substantially planar shape. In some embodiments, the engagements 171 can have the shape of upward or downward facing protrusions. In some embodiments, the engagements 171 can have a finger-like shape. In some embodiments, the engagements 171 can have the shape of interlocking teeth. The interlocking rails 141 are rigidly affixed to the back side 136*b* of the panel sheet 136. The interlocking rails 141 can be fabricated out of extruded aluminum and can be installed at a factory to the panel sheet 136.

Figure 17:
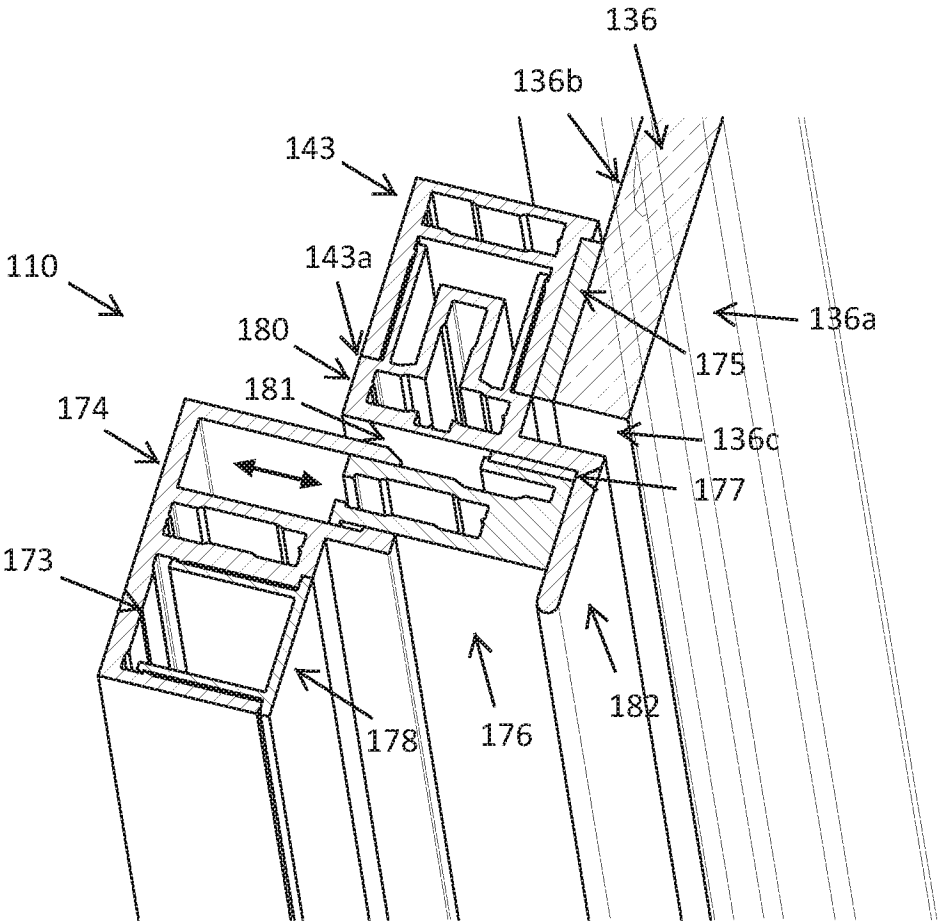
FIG. 17 illustrates a front closure assembly of a modular shower enclosure according to some embodiments of the invention.
Figure 18:
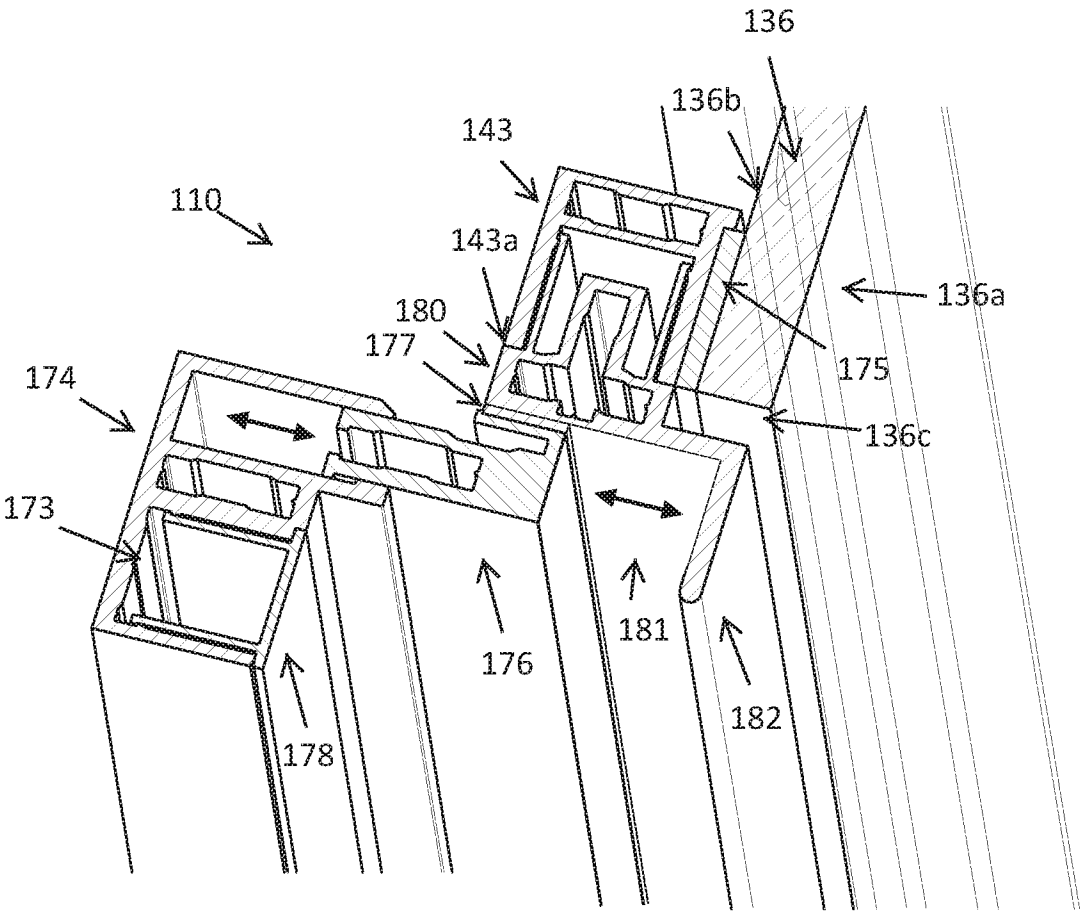
FIG. 18 illustrates a front closure assembly of a modular shower enclosure according to some embodiments of the invention.

FIGS. 16 to 18 illustrate a front closure assembly 110 according to some embodiments. As described more fully below, the front closure assembly 110 is horizontally expandable and compressible to account for out of plumb alcove 103 walls. The front closure assembly 110 can include wall mount 174, telescoping bracket 176, trim element 178, vertical rails 143, and support member 180. The components of the front closure assembly 110 may run the length of the side wall panels 108 and may be made out of extruded aluminum.

The vertical rails 143 are installed at a factory to the panel sheets 136 of the side surround panels 108. Upon assembly, the vertical rails 143 are spaced apart from the building alcove 103 by a predetermined space. A front edge 143*a* of the vertical rails 143 is flush with the front edge 136*c* of the panel sheets 136 (see FIGS. 17 and 18). The vertical rails 143 can be attached at a factory to the panel sheet 136 by an adhesive member 175. In some embodiments, the adhesive member 175 can be silicone tape, such as double-sided high strength bonding tape. In some embodiments, the silicone tape may be VHB™ tape manufactured by 3M™. Support member 180 may be snap fit into vertical rails 143. Upon installation, a vertical flange 182 of support member 180 may be flush with the front side 136*a* of the panel sheet 136.

Wall mount 174 includes a plurality of holes on face 173 for mounting to the alcove 103 via fasteners (not depicted). Telescoping bracket 176 can be attached to support member 180 via adhesive member 177. Adhesive members 175 and 177 may be made out of the same material or may be made out of different materials. Telescoping bracket 176 can be snap fit into wall mount 174. Wall mount 174 and telescoping bracket 176 can be horizontally adjusted during installation to achieve a desired width based on the dimensions of the alcove 103. As shown in FIGS. 17 and 18, two horizontal extensions are possible. Telescoping bracket 176 can be vertically extended within wall mount 174 and telescoping bracket 176 can also be moved along surface 181 of support member 180 away from flange 182. In some embodiments, the front closure assembly 110 may be horizontally extended or contracted up to two inches.

The front closure assembly 110 may be installed as follows. Telescoping bracket 176 is snap fit into wall mount 174 and support member 180 is snap fit into vertical rails 143. Telescoping bracket 176 is brought into a nested position in wall mount 174 such that telescoping bracket 176 is fully compressed relative to wall mount 174. Telescoping bracket 176 is then extended within wall mount 174 and/or moved away from flange 182 until wall mount 174 abuts alcove 103. Wall mount 174 is then attached to alcove 103 via fasteners and telescoping bracket 176 and attached to support member 180 via adhesive member 177. Trim element 178 may then be snap fit into wall mount 174 to hide the fasteners.

Figure 19:
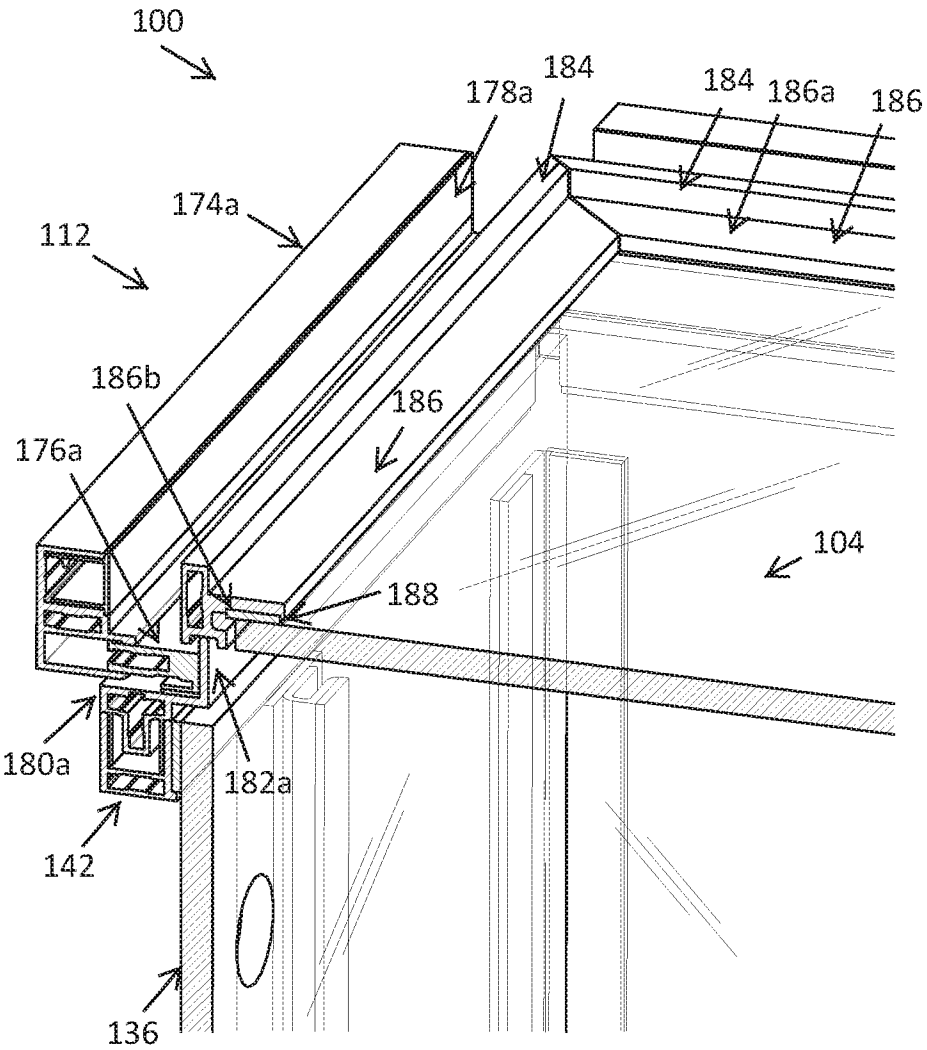
FIG. 19 illustrates a side closure assembly and a lid of a modular shower enclosure according to some embodiments of the invention.

FIG. 19 illustrates a side closure assembly 112 according to some embodiments. As shown in FIG. 19, the side closure assembly 112 can include similar components to the front closure assembly 110 having the same cross sections as corresponding components of the front closure assembly 110. The front closure assembly 110 can include wall mount 174*a*, telescoping bracket 176*a*, trim element 178*a*, horizontal rails 142, and support member 180*a*. The difference between the side closure assembly 112 and the front closure assembly 110 is that the side closure assembly 112 is mounted horizontally instead of vertically. The components of the side closure assembly 112 may be installed in a similar manner as the front closure assembly and the assembly steps will not be repeated.

Figure 20:
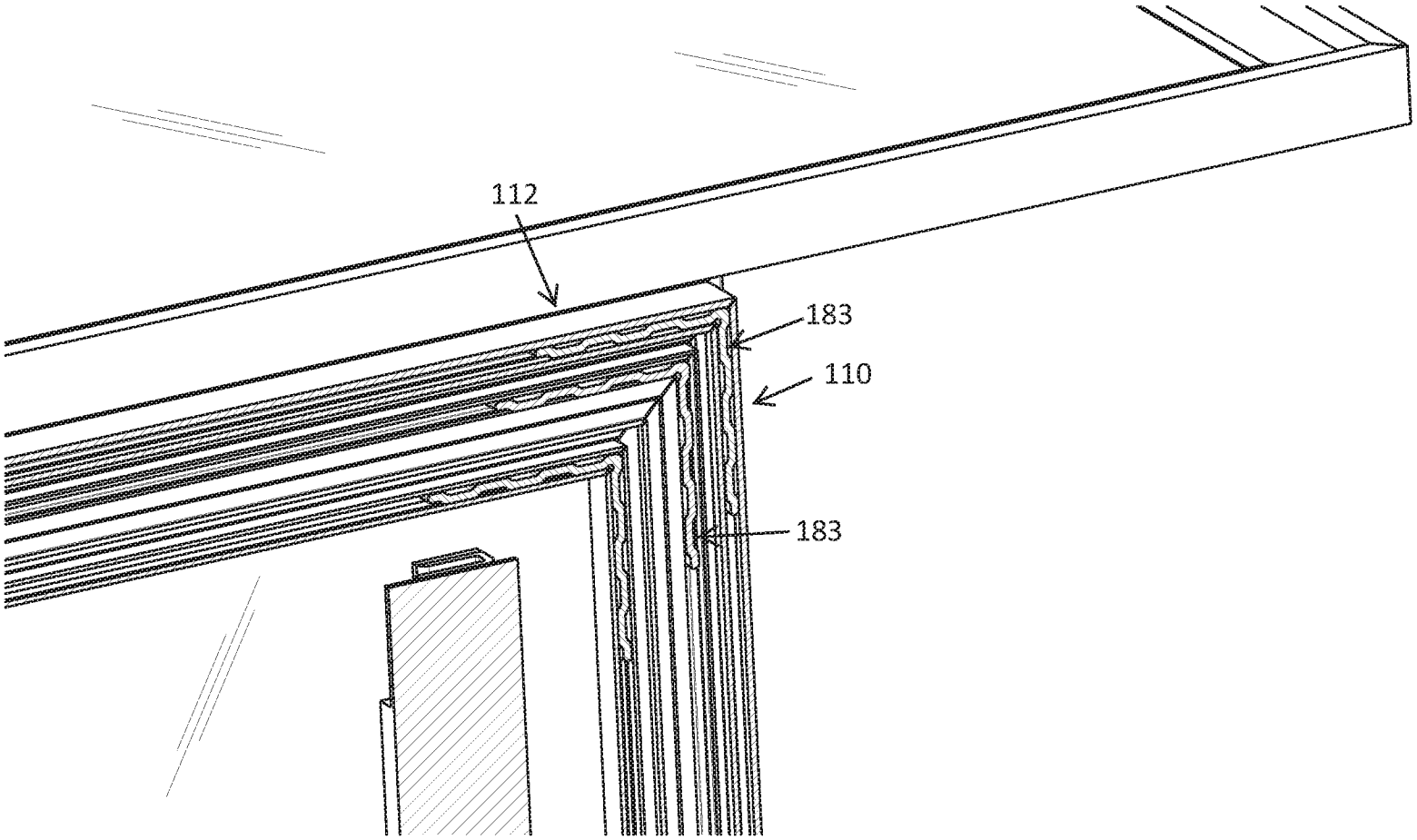
FIG. 20 illustrates a cross section of a joint between a front closure assembly and a side closure assembly according to some embodiments of the invention.

FIG. 20 illustrates a cross section of a joint between the front closure assembly 110 and the side closure assembly 112. As shown, the components of the front closure assembly and the side closure assembly may have miter joints with corner key wedges 183 fit snugly into the hollow spaces within the closure assembly 110, 112 components. The corner key wedges 183 can be L-shaped aluminum sleeves. The corner key wedges 183 can ensure that the miter joints line up and are fully mated.

FIG. 15 illustrates a rear closure assembly 114 according to some embodiments. The rear closure assembly 114 can have the same components as the side closure assembly 112 and can be installed in the same manner.

FIG. 19 illustrates a modular shower enclosure 100 with a mounted lid 104 according to some embodiments. As shown in FIG. 19, lid support brackets 184 may be provided on an edge of flange 182*a* of support member 180*a*. The lid support brackets 184 can include a horizontal flange 186 extending towards the interior of the shower with upper 186*a* and lower 186*b* surfaces for mounting the lid 104. The lid 104 may be attached to either the upper 186*a* or lower 186*b* surfaces of flange 186 via adhesive member 188. It should be appreciated that the lid 104 is optional and can be removed or not included in some embodiments.

A method of installing the modular shower enclosure 100 according to some embodiments is as follows. An alcove 103 can be prepared having securing surfaces for attaching the modular shower enclosure 100. The base 102 can then be installed in the alcove 103. Rear alignment supports 148 and side alignment supports 150 can then be positioned in a preselected relationship relative to engagement features 124 of the base 102. In some embodiments, one or more of the alignment supports 148, 150 are mounted to engagement features 124 on a rear wall 128 and side walls 126 of the base 102. In some embodiments, the alignment supports 148, 150 can be received in slots 125 of the base 102. The rear alignment supports 148 and side alignment supports 150 can then be mounted to the building alcove 103 via fasteners 154 and independently made "square" relative to the base 102 or independently leveled using one or more shims 158. The alignment supports 148, 150 can be independently made "square" or level relative to the base 102 using different numbers of shims 158 at different locations of the alignment supports 148, 150. In some embodiments, the alignment supports 148, 150 may be placed in a preselected "square" position relative to the base 102. That is, in the installed position, the alignment supports 148, 150 are situated to maintain the surround panels 106, 108 in a relationship to the base 102 such that the panels 106, 108 form a rectangular enclosure in which they are substantially perpendicular to the base 102 and to each other. One or more rear surround panels 106 can then be vertically attached to the rear alignment supports 148. Coupling portions 144 of rear mounting rails 138 on the rear surround panels 106 can be vertically dropped into engagement with coupling mounts 160 of the rear alignment supports 148. The side surround panels 108 can then be horizontally attached to the rear alignment supports 148 and to the rear surround panels 106. Coupling portions 147 of the side mounting rails 139 on the side surround panels 108 can be horizontal slid into engagement with coupling mounts 162 of the side alignment supports 150. Interlocking rails 140, 141 of the rear surround panels 106 and side surround panels 108 can be brought into engagement at rear corners of the modular shower enclosure 100. Front closure assemblies 110, side closure assemblies 112, and a rear closure assembly 114 can then be attached to the rear surround panels 106 and the side surround panels 108. Lid brackets 184 and a lid 104 can then be mounted to the modular shower enclosure 100. Shower doors can then be installed.

Shower doors can form a front wall of the shower enclosure 100 to prevent water from getting out onto the bathroom floor while the shower is in use. A variety of glass and metal frame shower doors may be available with the modular enclosure 100 as aesthetic options. Shower doors may be hung from a metal door rail that is affixed to a front portion of the shower enclosure 100. The metal door rail may be used to support the surround panels 106, 108, front closure assemblies 110, and/or side closure assemblies 112. Where a shower door rail is not available, as in the case of some pivot doors, a shower door frame may be modified to support the surround panels 106, 108, front closure assemblies 110, and/or side closure assemblies 112.

FIGS. 21A-21C illustrate alignment supports 248 according to some embodiments. Like parts as the alignment supports 148, 150 are referenced with the same numerals, and the description thereof will not be repeated herein. The alignment supports 248 according to the embodiments illustrated in FIGS. 21A-21C are horizontally extending elongate supports. The alignment supports 248 may include rear alignment supports used to mount rear surround panels to the shower enclosure 100 and to the building alcove 103, and/or side alignment supports used to mount side surround panels to the shower enclosure 100 and to the building alcove 103. As shown in FIGS. 21A-21C, the alignment supports 248 can include coupling mounts 260 to connect to coupling portions 244 of the surround panels 206. In some embodiments, the coupling mounts 260 can vertically receive coupling portions 244 of the surround panels 206. The coupling mounts 260 can include a flange 260*a* and slot 260*b* that receives a corresponding flange 244*a* of the surround panels 206. The coupling mounts 260 may be of a single piece construction with the alignment supports 248 (e.g., a single extruded aluminum piece), or may be a separate component attached to the alignment supports 248 (e.g., by fasteners and/or adhesive).

As shown in FIG. 21A, the alignment supports 248 may be directly connected to the alcove 103 using one or more fasteners 254. The alignment supports 248 may have a plurality of horizontally and/or vertically spaced through holes 252 which can be used to connect the alignment supports 248 to the alcove 103 via the fasteners 254. In some embodiments, the alignment supports 248 can be independently made "square" or level despite any deviations that might exist in the alcove 103 wall. The alignment supports 248 may be positioned in a preselected "square" position relative to the base 102. As shown in FIG. 21B, the alignment supports 248 may be constructed of one or more parts 248*a*, 248*b* that are connected via one or more fasteners 256. The one or more parts 248*a*, 248*b* of the alignment supports 248 may be separable. The parts 248*a*, 248*b* can be used to independently adjust the distance of the coupling mounts 260 to the wall alcove 103 during installation. For example, a first part 248*a* can first be mounted to the alcove 103 followed by mounting a second part 248*b* to the first part 248*a*. The second part 248*b* is configured to connect to the coupling portions of the surround panel. As such, the first part 248*a* can be used to extend the distance of the coupling mount 260 to the alcove 103 relative to mounting the second part 248*b* directly to the alcove 103. While FIG. 21B depicts alignment supports 248 with two connectable parts 248*a*, 248*b*, it should be appreciated that the alignment supports 248 may include additional connectable parts. As shown in FIG. 21C, one or more shims 258 may be provided that adjust the distance of the coupling mounts 260 to the wall alcove 103. The one or more shims 258 may be used with alignment supports 248 that have connectable parts and/or may be used with alignment supports 248 that have a single piece construction. The one or more shims 258 may be placed between the connectable parts of the alignment supports 248. The connectable parts of the alignment supports 248 and/or the shims 258 may be used to accommodate for alcove 103 walls that are out of plumb. The connectable parts of the alignment supports 248 and/or the shims 258 can ensure that the surround panels 206 are precisely "square" with the configuration of the shower base 102 or level despite any deviations that might exist in the wall itself. Alignment supports 248 of different configurations (e.g., with or without separable parts, or having separable parts of different sizes) can be placed at different locations along the alcove wall 103 to accommodate for alcove walls that are out of plumb. Similarly, different numbers of shims 258 may be used with different alignment supports 248.

The modular shower enclosure 100 allows translucent panel sheet 136 material to be backlit as an aesthetic option. The modular shower enclosure 100 can easily accommodate backlighting as the panel sheet 136 material may be offset from the bathroom walls by approximately 2 inches. This space between the walls and the panel sheet 136 material allows LED rope lighting to be threaded into the space to backlight the panel sheet 136 material. The base 102, alignment supports 148, 150, front closure assemblies 110, side closure assemblies 112, and/or rear closure assembly 114 can act to support the LED rope lighting. Access to the rope lighting can be made through the front closure assemblies 110, in that if the front closure assemblies 110 are removed, maintenance workers can access the rope light connections.

Figure 22:
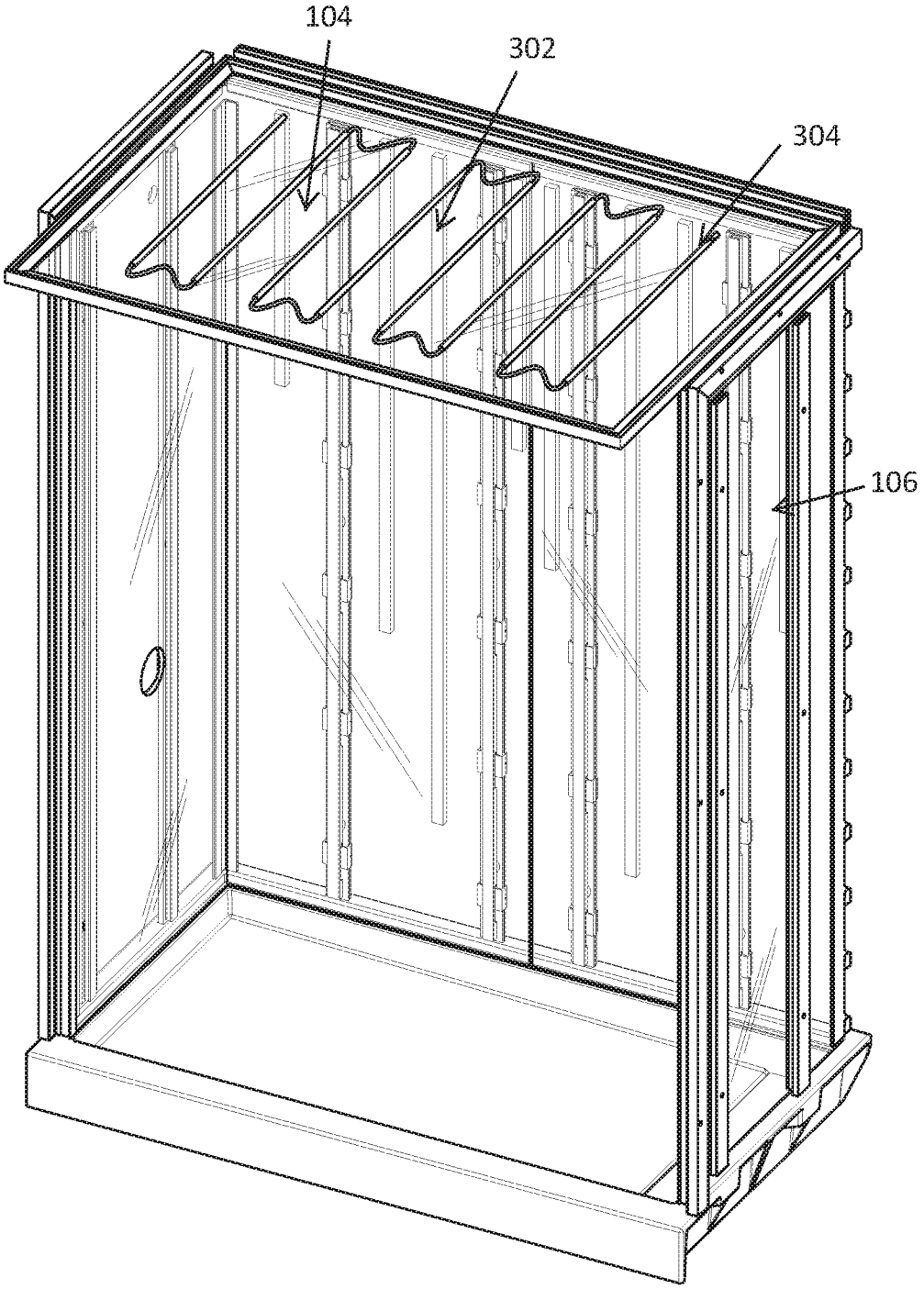
FIG. 22 illustrates lighting elements of a modular shower enclosure according to some embodiments of the invention.

FIGS. 22-25 depict lighting elements 302, 304 of the modular shower enclosure 100 according to some embodiments. The lighting elements 302, 304 can be used to backlight the shower enclosure 100 to provide an aesthetic appeal. As shown in FIG. 22, the modular shower enclosure 100 can include lighting elements 302 incorporated into the surround panels 106, 108 (e.g., the rear surround panels 106 and/or side surround panels 108). The shower enclosure 100 can also include lighting elements 304 incorporated into the lid 104.

Figure 23:
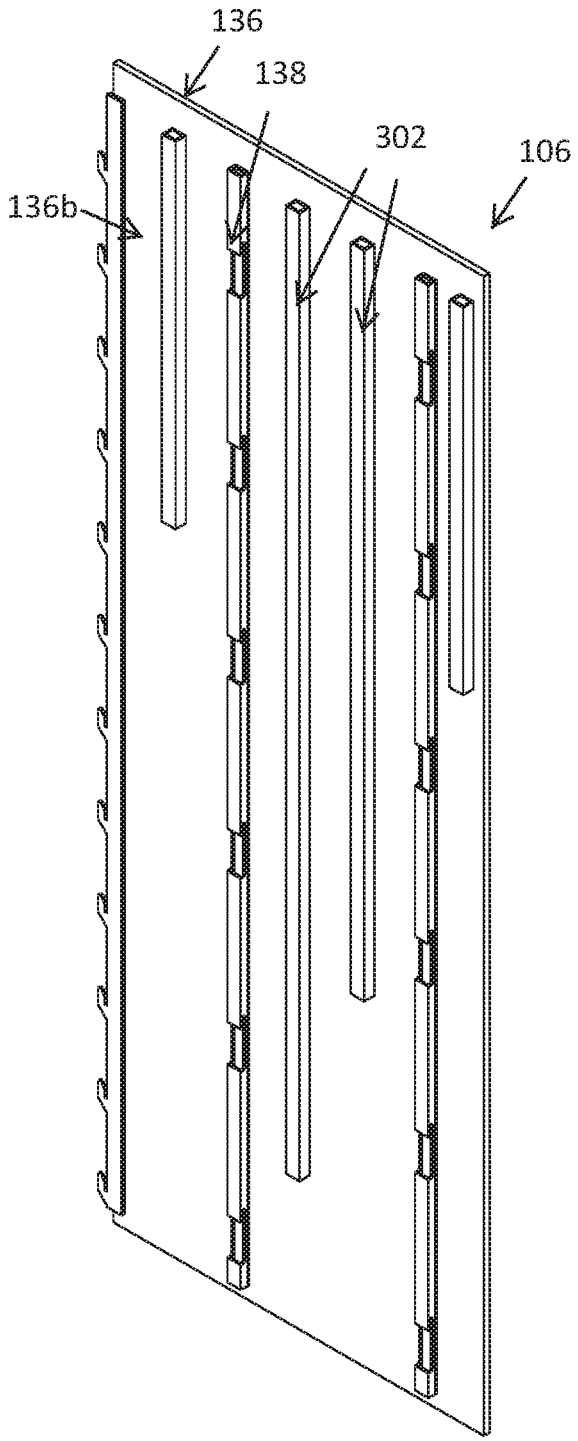
FIG. 23 illustrates lighting elements incorporated into a surround panel according to some embodiments of the invention.

FIG. 23 illustrates lighting elements 302 incorporated into the rear surround panels 106 according to some embodiments. As shown in FIG. 23, the lighting elements 302 can be located on the same side of the panel sheet 136 as the rear mounting rails 138 (i.e., the back side 136*b* of the panel sheet 136). As such, the lighting elements 302 can avoid contact with the water flowing inside of the shower enclosure 100. The lighting elements 302 can be attached to the panel sheet 136 via fasteners and/or adhesive. The panel sheet 136 may be made of a transparent or semi-transparent material and when the lighting elements 302 are activated, the lighting elements 302 can at least partially shine through the panel sheet 136 to illuminate the interior of the shower enclosure 100. As shown in FIG. 23, the lighting elements 302 can include vertically extending lights. In some embodiments, the lighting elements 302 may be light emitting diode ("LED") tape-lights and/or LED strip-lights, such as linear wet location LED strip-lights. In some embodiments, the lighting elements 302 may be housed in aluminum channels. When multiple lighting elements 302 are used, the lighting elements 302 may be electrically connected and connected to one or more power sources. The lighting elements 302 may have different shapes and sizes. As shown in FIG. 23, in some embodiments, the lighting elements 302 include a plurality of vertically extending lighting elements 302 that are spaced apart. The plurality of vertically extending lighting elements 302 can include different lengths to create a cascading or waterfall effect.

Figure 24:
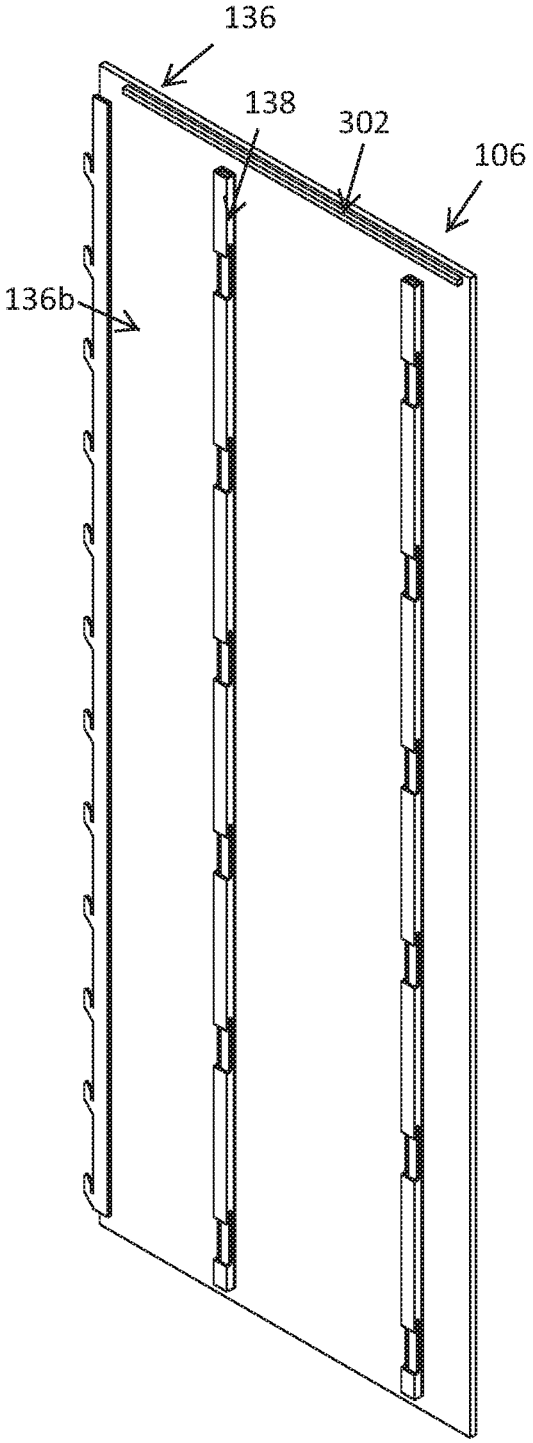
FIG. 24 illustrates lighting elements incorporated into a surround panel according to some embodiments of the invention.

FIG. 24 illustrates lighting elements 302 incorporated into the rear surround panels 106 according to some embodiments. As shown in FIG. 24, the lighting elements 302 can be located on the same side of the panel sheet 136 as the rear mounting rails 138 (i.e., the back side 136*b* of the panel sheet 136). The lighting elements 302 can be attached to the panel sheet 136 via fasteners and/or adhesive. As further shown in FIG. 24, the lighting elements 302 can include horizontally extending lights. The lighting elements 302 can be located at an upper edge of the rear surround panels 106 and can be LED lights. In some embodiments, the lighting elements 302 can be one or more extruded aluminum linear illumination systems and/or track lighting. In some embodiments, the lighting elements 302 can include a linear wall grazer. While FIGS. 23 and 24 were described with reference to the rear surround panels 106, it should be appreciated that the lighting elements 302 can be incorporated into the side surround panels 108.

Figure 25:
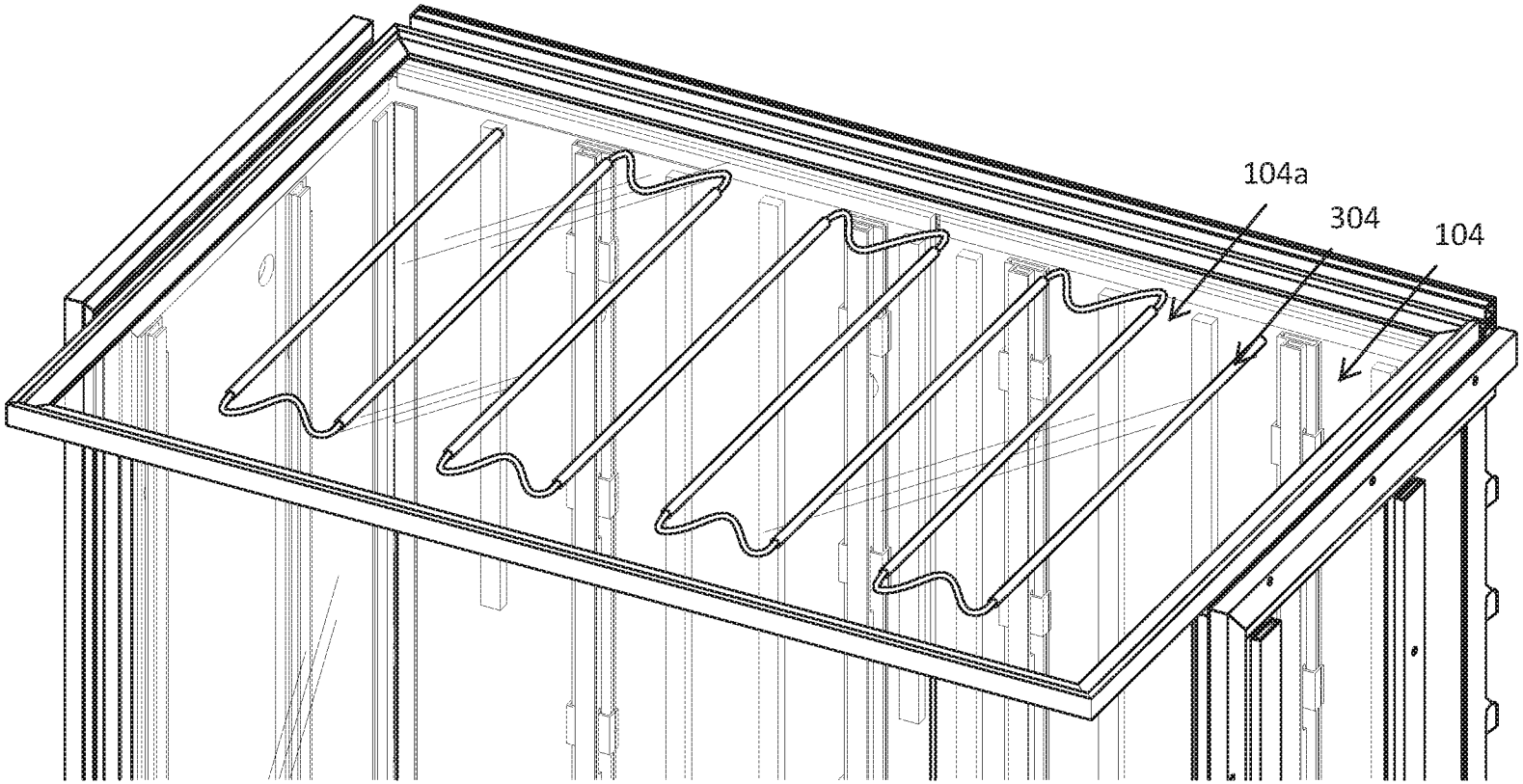
FIG. 25 illustrates lighting elements incorporated into a lid according to some embodiments of the invention.

FIG. 25 illustrates lighting elements 304 incorporated into the lid 104 according to some embodiments. As shown in FIG. 25, the lighting elements 304 can be located on an upper surface 104*a* of the lid 104 that faces away from the interior of the shower enclosure 100. As such, the lighting elements 304 can avoid contact with the water flowing inside of the shower enclosure 100. The lighting elements 304 can be attached to the lid 104 via fasteners and/or adhesive. The lid 104 may be made of a transparent or semi-transparent material and when the lighting elements 304 are activated, the lighting elements 304 can at least partially shine through the lid 104 to illuminate the interior of the shower enclosure 100. When multiple lighting elements 304 are used, the lighting elements 304 may be electrically connected and connected to one or more power sources. The lighting elements 304 may have different shapes and sizes. As shown in FIG. 25, in some embodiments, the lighting elements 304 include a plurality of spaced apart elongate lights. In some embodiments, the lid 104 can include apertures of various sizes to create a starry sky effect.

Figure 26:
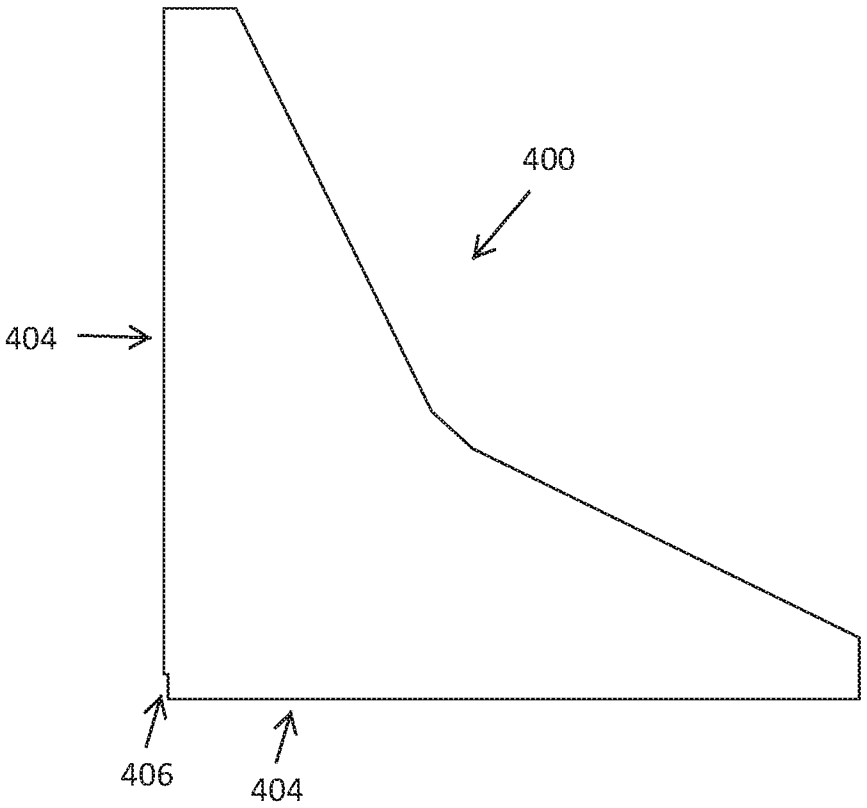
FIG. 26 illustrates a tool for installing a modular shower enclosure according to some embodiments of the invention.

FIG. 26 illustrates a tool 400 for installing the modular shower enclosure 100. The tool can include a substantially vertical edge 402 to align the alignment supports 148, 150, 248 for installation. The tool can include a substantially horizontal edge 404 to extend across a planar surface 133 of the base 102 (see FIG. 3). The tool can additionally include a notch 406 to account for the lip 132 of the base 102 when the tool is placed on the planar surface 133. In some embodiments, the vertical edge of the tool 400 can be up to 62 inches long. In some embodiments, the horizontal edge 404 can be up to 557/8 inches long. In some embodiments, when the horizontal edge 404 is placed on the planar surface 133, the tool 400 extends between the planar surfaces 133 adjacent both side walls 126 of the base 102 (e.g., left and right side walls 126) and spans a width of the sloped floor 120. In use, first the base 102 may be installed. Next, the alignment supports 148, 150 are positioned in a preselected relationship relative to the one or more engagement features 124 of the base. In some embodiments, the alignment supports 148, 150 may be placed into engagement with the base 102. In some embodiments, lower portions of the alignment supports 148, 150 may be mated with the engagement features 124 of the base 102. Next, the horizontal edge 404 of the tool 400 may be placed in contact with the planar surface 133 of the base and the vertical edge 402 of the tool 400 may be placed adjacent one of the alignment supports 148, 150. The notch 406 of the tool 400 may be placed adjacent the lip 133 of the base 102. The vertical edge 402 of the tool 400 may be used to plumb the alignment supports 148, 150, i.e., to aid in positioning the alignment supports 148, 150 in a preselected "square" position relative to the base 102. That is, in the installed position, the alignment supports 148, 150 are situated to maintain the surround panels 106, 108 in a relationship to the base 102 such that the panels 106, 108 form a rectangular enclosure in which they are substantially perpendicular to the base 102 and to each other. Shims 158 can be used to align the alignment supports 148, 150 with the vertical edge 402 of the tool 400. The tool 400 may be used to independently align each alignment support 148, 150.

In some embodiments, the modular shower enclosure 100 can include surround panels 106, 108 that connect to the base 102 via engagement features 190 on the panels 106, 108. The surround panels 106, 108 can have mounting rails 138, 139 with engagement features 190 (not illustrated) that engage the base 102. In some embodiments, the engagement features 190 can engage the engagement features 124 of the base 102. In such embodiments, the alignment supports 148, 150 may be excluded. The engagement features 190 of the mounting rails 138, 139 may be vertically extending supports that extend below the lower edge of the panel sheet 136. In some embodiments where the base 102 has slots 125, the engagement features 190 may be sized to be received in the slots 125. In such embodiments, the shower enclosure 100 can include horizontal members 192 (not illustrated) that connect upper portions of the panels 106, 108 to the alcove 103. Shims may be used to plumb the horizontal members 192 relative to the alcove 103 to ensure that the surround panels 106, 108 are precisely vertical in a direction perpendicular to the alcove wall despite any deviations that might exist in the wall itself. Trim pieces, such front closure assembly 110 and side closure assembly 112, may be used to close any gaps between the shower enclosure and the alcove 103 and to provide a barrier against leakage.

Figure 27:
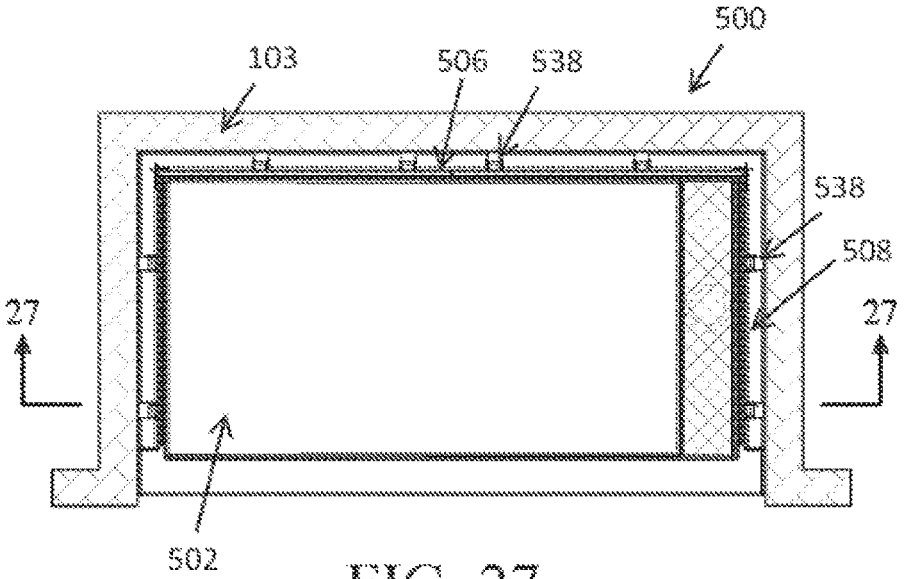
FIGS. 27 and 28 illustrate a shower enclosure according to some embodiments of the invention.
Figure 28:
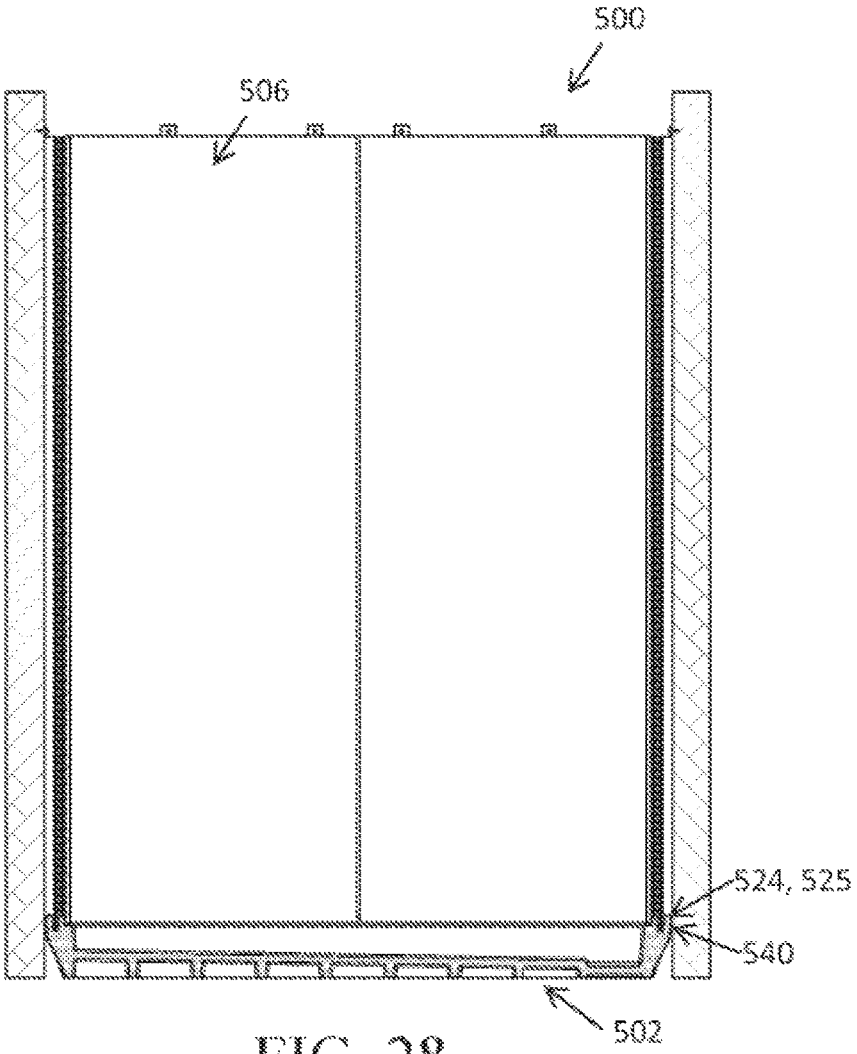

FIGS. 27-31B illustrate a shower enclosure 500 having surround panels 506, 508 according to some embodiments. Like parts as the previous embodiments are referenced with the same numerals, and the description thereof will not be repeated herein. As shown in FIGS. 27 and 28, the shower enclosure 500 can include a base 502, one or more rear surround panels 506, and one or more side surround panels 508. The surround panels 506, 508 can be connected to the base 502 and the alcove 103 as described below.

Figure 29A:
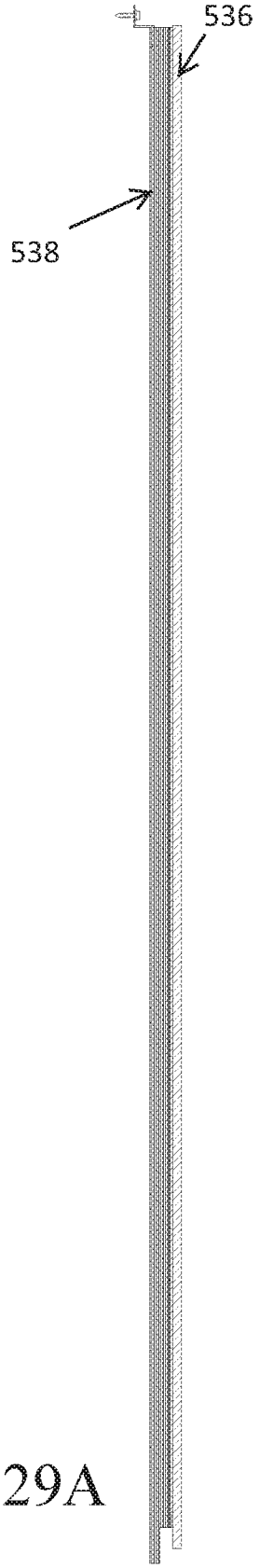
FIGS. 29A-31B illustrate surround panels according to some embodiments of the invention.
Figure 29B:
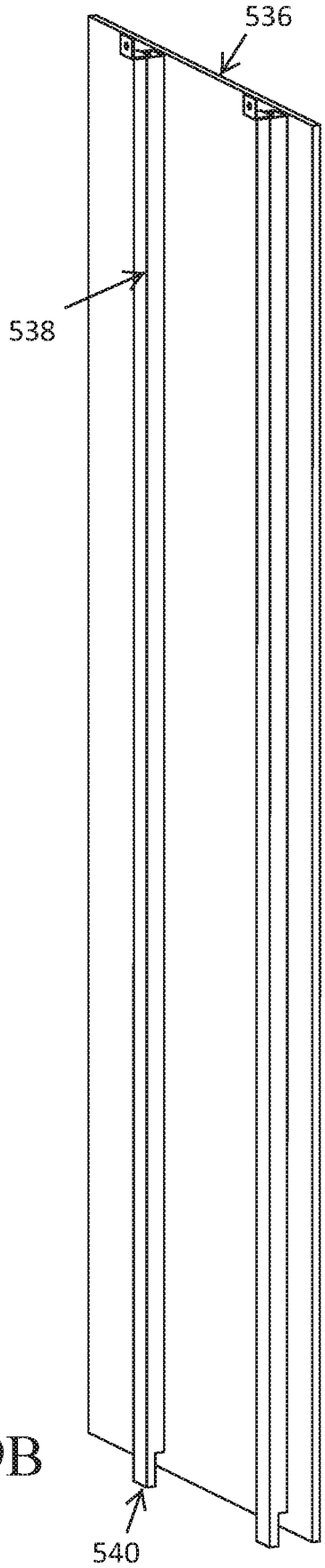
Figure 30C:
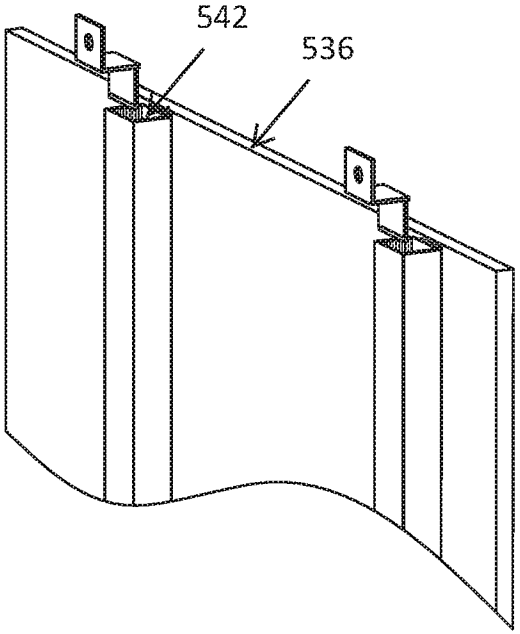
Figure 30B:
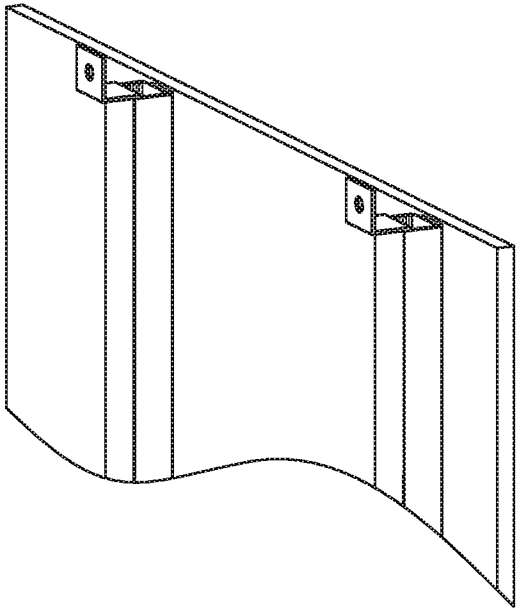
Figure 30A:
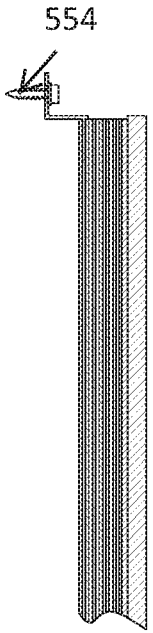

As shown in FIGS. 29A-29B, the surround panels 506, 508 can include mounting rails 538 on a backside of the panel sheet 536 of the surround panels 506, 508. The mounting rails 538 can be formed as elongate supports that extend vertically along a backside of the panel sheet 536. The mounting rails 538 can be rigidly attached to the panel sheet 536 via an adhesive member 575 (see FIGS. 31A-31B). In some embodiments, the mounting rails 538 are attached to the panel sheet 536 by silicone tape, such as double-sided high strength bonding tape. In some embodiments, the silicone tape may be VHB™ tape manufactured by 3M™. In some embodiments, the mounting rails 538 may be attached to the panel sheet 536 by mechanical fasteners. In some embodiments, the adhesive member 575 can have a nominal width of ⅛ of an inch.

To install the surround panels 506, 508, in some embodiments, lower portions 540 of the mounting rails 538 may be mated with engagement features 524 of the base 502. In some embodiments where the engagement features 524 have slots 525, the lower portions 540 of the surround panels 506, 508 can be sized to be received in the slots 525 of the base 502 as shown in FIG. 28. In some embodiments, when the surround panels 506 are mated to the base 502, lower portions of the panel sheets 536 of the surround panels 506 can rest on the base 502 as shown in FIG. 28. When the slots 525 have rectangular cross sections, the cross sections of lower portions of the mounting rails 538 can have corresponding rectangular cross sections sized to be received in the slots 525. In some embodiments, the mounting rails 538 have uniform cross sections. In some embodiments, the mounting rails 538 can have a width of approximately 1 inch.

Figure 31B:
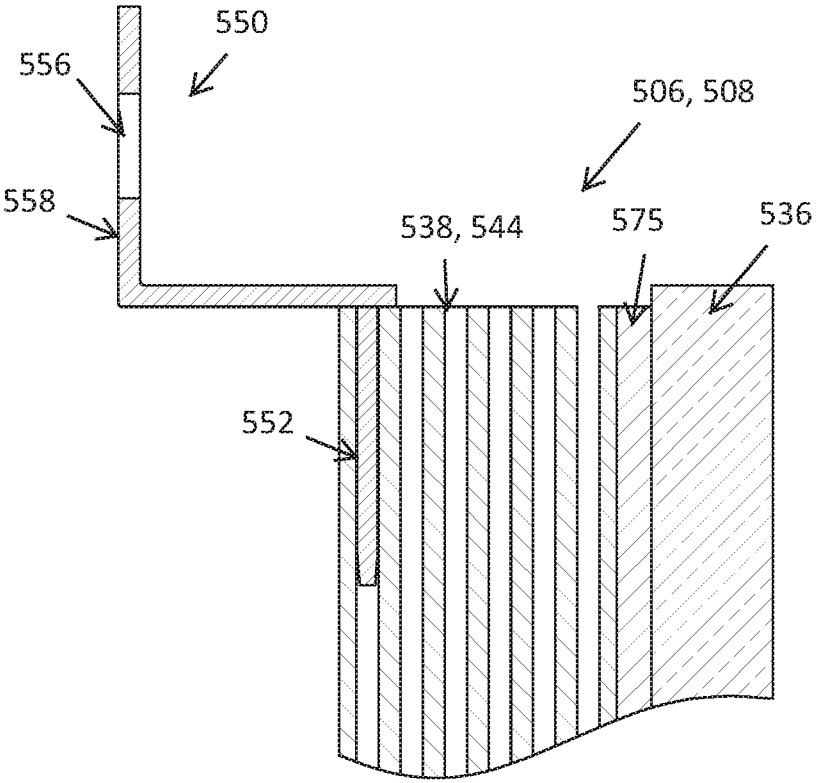
Figure 31A:
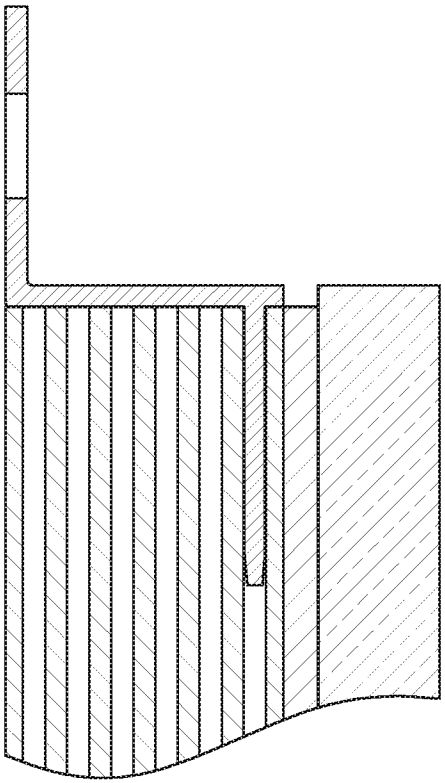
Figure 32A:
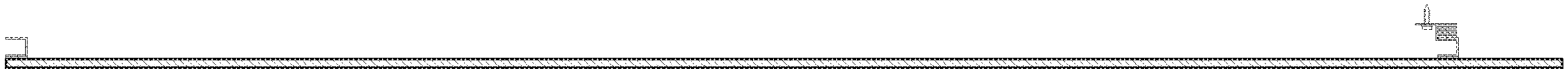
FIGS. 32A-34B illustrate surround panels according to some embodiments of the invention.
Figure 32B:
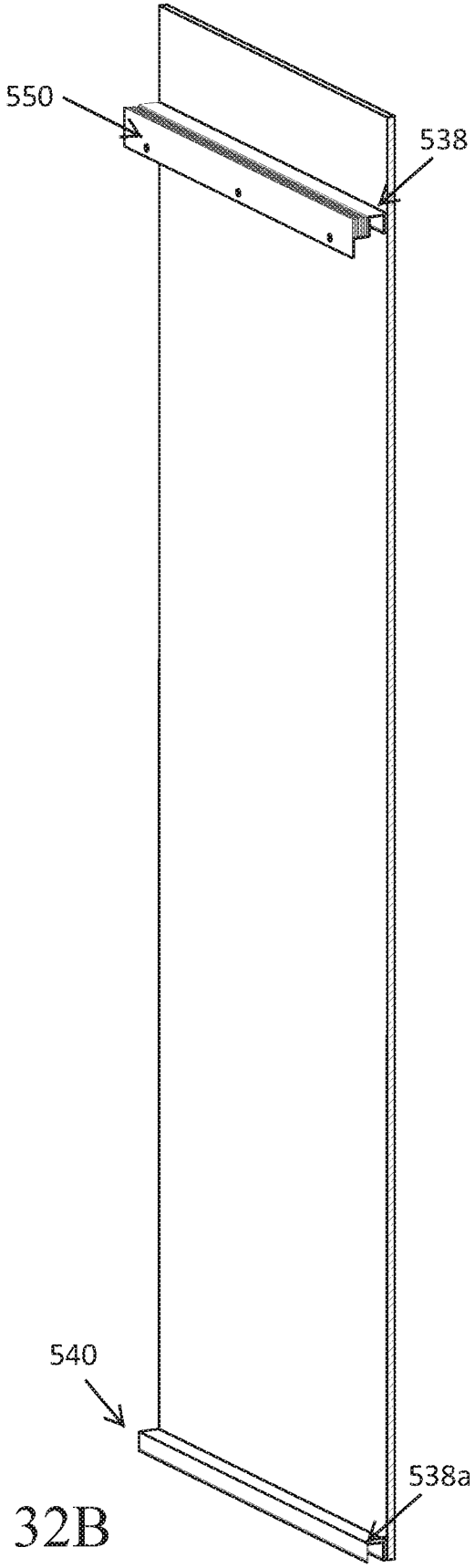
Figure 33B:
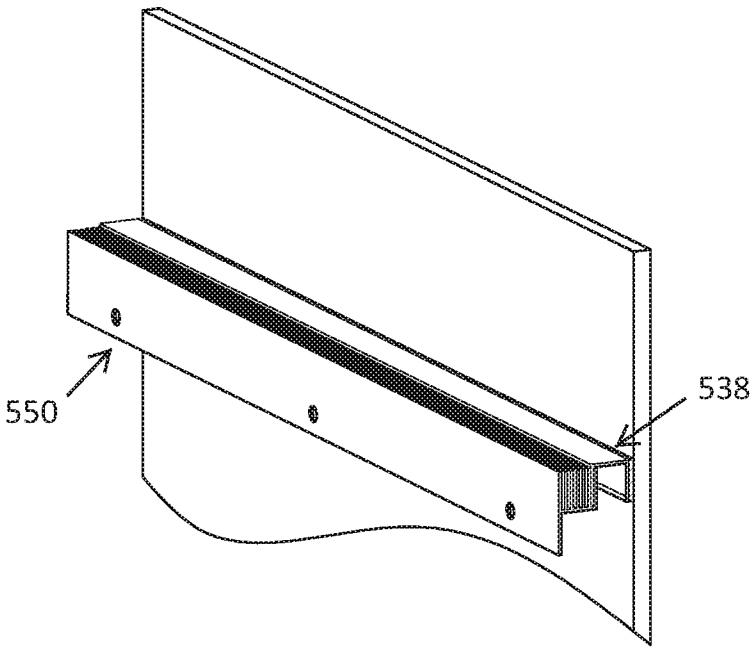
Figure 33A:
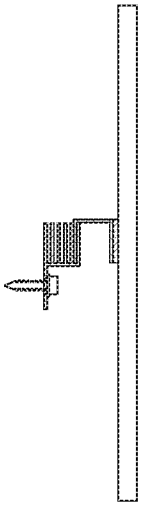

As shown in FIGS. 30A-31B, an upper portion 542 of the mounting rails 538 can be connected to the alcove 103 via a wall connector 550. The wall connector 550 can include a vertically extending surface 558 configured to abut the alcove 103. The wall connector 550 can have one or more through holes 556 to connect the wall connector 550 to the alcove 103 via fasteners 554. In some embodiments, the wall connector 550 can have a width of about 1 inch to 2.2 inches. The upper portion 542 of the mounting rails 538 can include a plurality of different engagement locations 544, each configured to mate to the wall connector 550. In some embodiments, the plurality of different engagement locations 544 can be slots, for example vertical slots, each configured to receive the wall connector 550. The wall connector 550 can include a blade or post 552 configured to be inserted into the slots of the mounting rails 538. In some embodiments, the blade 552 can extend vertically downward. As shown in FIGS. 31A-31B, the wall connector 550 can be adjusted between different engagement locations 544 to adjust the distance between the wall abutting surface 558 and the surround panels 506, 508. During installation, the wall connector 550 can be mated with a desired engagement location 554 to align the surround panels 506, 508 (e.g., to plumb the surround panels 506, 508). By adjusting the mated engagement location 554, the wall connector 550 may be used to accommodate for alcove walls that are out of plumb while still achieving the rectilinear "square" relationship of the surround panels 106, 108 relative to the base 102. In some embodiments, shims may be used with the wall connector 550 to further adjust the "square" configuration of the surround panels 506, 508.

A method of installing the modular shower enclosure 500 according to some embodiments is as follows. An alcove 103 can be prepared having securing surfaces for attaching the modular shower enclosure 500. The base 502 can then be installed in the alcove 103. Mounting rails 538 of the surround panels 506, 508 can be mated with engagement features 524 of the base 502. In some embodiments, the mounting rails 538 can be received in slots 525 of the base 102. For each of the mounting rails 538, a wall connector 550 can be attached to different engagement locations 554 of the mounting rails 538 based on the distance between the panel 536 and the alcove 103 to level the surround panels 506, 508. In some embodiments, a blade 552 of the wall connector 550 can be received in slots in the mounting rails 538. The surround panels 506, 508 can be positioned in a "square" position relative to the base 102 using one or more shims. The wall connectors 550 can then be attached to the alcove 103 via the fasteners 554.

Figure 34B:
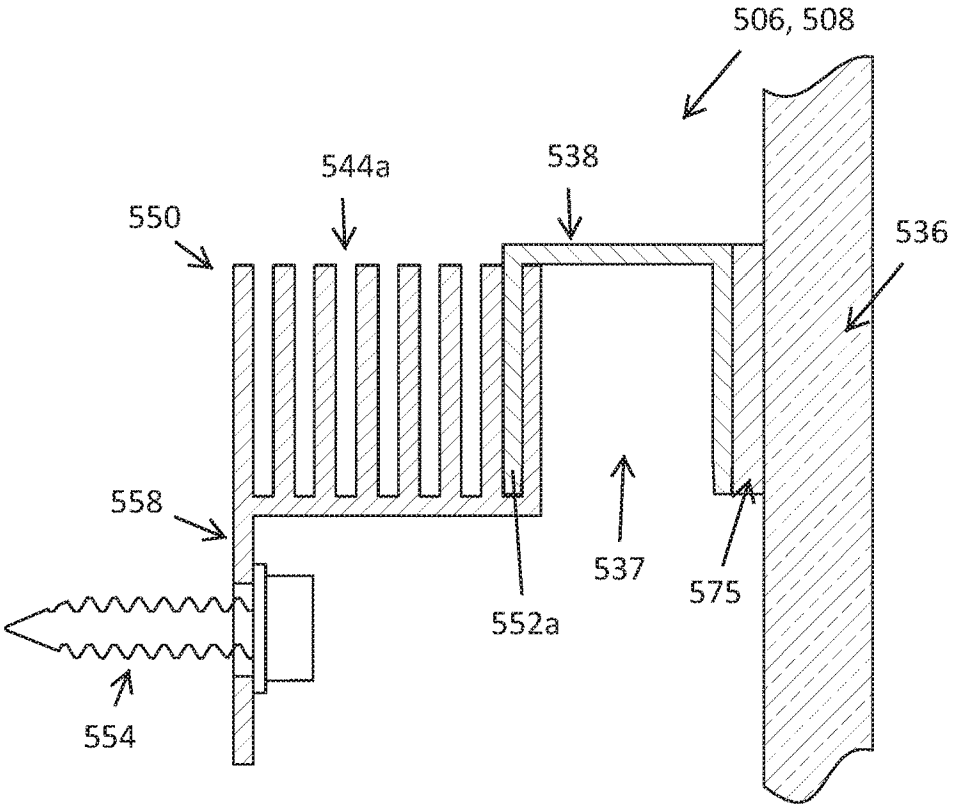
Figure 34A:
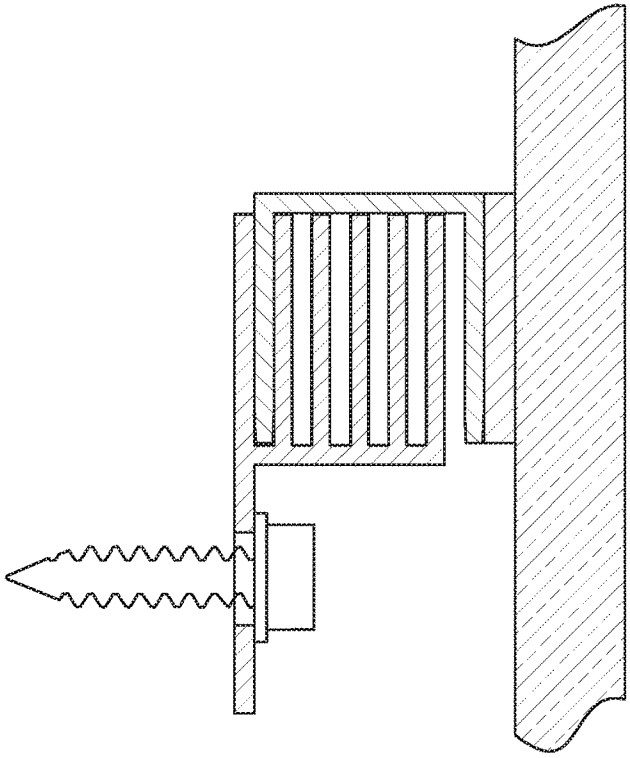

FIGS. 32A-34B illustrate a shower enclosure 500 according to some embodiments. Like parts as in the embodiments shown in FIGS. 29A-31B are referenced with the same numerals, and the description thereof will not be repeated herein. FIGS. 32A-34B differ from the embodiments shown in FIGS. 29A-31B in that the mounting rails 538 are substantially horizontal instead of vertical. As shown in FIGS. 34A-34B, different from the embodiments in FIGS. 29A-31B, the wall connector 550 includes the plurality of different engagement locations 544*a* configured to mate to the mounting rails 538. In some embodiments, the plurality of different engagement locations 544*a* can be slots, for example vertical slots, each configured to receive the mounting rails 538. The mounting rail can include a blade or post 552*a* configured to be inserted into the slots of the wall connector 550. In some embodiments, the blade 552*a* can extend vertically downward. The surround panels 506, 508 may have a plurality of elongate mounting rails 538. In some embodiments, the surround panels 506, 508 may have mounting rails 538*a* located at lower portions 540*a* of the surround panels 506, 508. Mounting rails 538*a* at the lower portions 540*a* of the surround panels 506, 508 may be mated with engagement features 524 of the base 502. In some embodiments, the engagement features 524 of the base 502 may be raised protrusions and may have a shape that corresponds to an inner profile 537 of the mounting rails 538*a*. In some embodiments, the lower mounting rails 538*a* can be mounted to the raised protrusions of the engagement features 524.

A method of installing the modular shower enclosure 500 according to some embodiments is as follows. An alcove 103 can be prepared having securing surfaces for attaching the modular shower enclosure 500. The base 502 can then be installed in the alcove 103. The wall connectors 550 can be attached to the alcove 103 via the fasteners 554. Lower mounting rails 538*a* of the surround panels 506, 508 can be mated with engagement features 524 of the base 502 and the mounting rails 538 can be mated with the engagement locations 544*a* of the wall connectors 550. In some embodiments, an inner profile 537 of the lower mounting rails 538*a* can be mated to raised protrusions of the engagement features 524 of the base 102. In some embodiments, a blade 552*a* of the mounting rails 538 can be received in slots in the wall connector 550. In some embodiments, the surround panels 506, 508 can be vertically dropped into place to form connections for the mounting rails 538 and the lower mounting rails 538*a*. In some embodiments, the surround panels 506, 508 can be aligned or arranged in a "square" position relative to the base 102 using one or more shims.

While the present invention has been described in connection with certain exemplary embodiments, it is to be understood that the invention is not limited to the disclosed embodiments, but is instead intended to cover various modifications and equivalent arrangements included within the spirit and scope of the appended claims, and equivalents thereof.

What is claimed is:

1. A shower enclosure comprising:

a base having one or more engagement features along a peripheral surface of the base;

a surround panel having a front side and a back side, the front side being configured to face an interior of the shower enclosure and the back side having at least one mounting member;

the at least one mounting member including a base-engageable mounting member that is engageable with the one or more engagement features of the base;

the at least one mounting member including a wall-connectable mounting member that is connectable to a wall or stud in a manner that facilitates adjusting a spacing between the surround panel and the wall or stud;

the wall-connectable mounting member comprising a wall connection assembly having a mounting member-engaging part and a wall-engaging part that are adjustably interconnected for selective positioning relative to each other in a direction normal to the back side of the surround panel; and the surround panel and the at least one mounting member being attached together for mounting as a unit to the base, the unit being configured to be made square relative to the base while engaging the base.

2. The shower enclosure of claim 1, wherein the at least one mounting member comprises at least one rail that extends in a substantially vertical direction.

3. The shower enclosure of claim 1, wherein the at least one mounting member comprises at least one rail that extends in a substantially horizontal direction.

4. The shower enclosure of claim 1, wherein the wall connection assembly is adjustable to adjust a spacing between the surround panel and the wall or stud after the unit is mounted to the base.

5. The shower enclosure of claim 1, wherein one of the wall connection assembly's mounting member-engaging part or wall-engaging part comprises a plurality of slots configured to receive the other of the wall connection assembly's mounting member-engaging part or wall-engaging part.

6. The shower enclosure of claim 1, further including at least one interlocking member located on a vertical edge of the surround panel, the at least one interlocking member being connectable to at least one interlocking member of an adjacent surround panel at a corner of the shower enclosure.

7. The shower enclosure of claim 1, wherein the one or more engagement features of the base include one or more slots and the at least one mounting member includes the base-engageable mounting member being configured to be vertically received in the one or more slots.

8. The shower enclosure of claim 1, wherein the mounting member-engaging part of the wall connection assembly comprises a plurality of slots configured to receive the wall-engaging part of the wall connection assembly.

9. The shower enclosure of claim 1, wherein the mounting member-engaging part of the wall connection assembly is configured to engage one of a plurality of slots of the wall-engaging part of the wall connection assembly.

10. The shower enclosure of claim 1, wherein there are at least two mounting members, each mounting member having a lower portion engageable with one of the one or more engagement features of the base, and an upper portion connectable to a wall or stud in a manner that facilitates adjusting a spacing between the surround panel and the wall or stud.

11. A method of installing a shower enclosure:

the shower enclosure comprising:

a base having one or more engagement features along a peripheral surface of the base;

a surround panel having a front side and a back side, the front side being configured to face an interior of the shower enclosure and the back side having at least one mounting member;

the at least one mounting member including a base-engageable mounting member that is engageable with the one or more engagement features of the base;

the at least one mounting member including a wall-connectable mounting member that is connectable to a wall or stud in a manner that facilitates adjusting a spacing between the surround panel and the wall or stud;

the wall-connectable mounting member comprising a wall connection assembly having a mounting member-engaging part and a wall-engaging part that are adjustably interconnected for selective positioning relative to each other in a direction normal to the back side of the surround panel; and the surround panel and the at least one mounting member being attached together for mounting as a unit to the base, the unit being configured to be made square relative to the base while engaging the base;

the method comprising:

installing the base;

attaching the surround panel to the at least one mounting member to form the unit that mounts to the base;

mounting the unit to the base by engaging the base-engageable mounting member of the unit to the one or more engagement features of the base;

connecting the wall-connectable mounting member of the unit to the wall or stud; and adjusting a spacing between the surround panel and the wall or stud at a location where the wall-connectable mounting member of the unit is connected to the wall or stud to make the unit square relative to the base.

12. The method of claim 11, wherein the step of adjusting a spacing between the surround panel and the wall or stud includes adjusting the wall connection assembly in the normal direction.

13. The method of claim 11, wherein the one or more engagement features of the base include one or more slots and the base-engageable mounting member is configured to be vertically received in the one or more slots, and wherein the step of mounting the unit to the base includes vertically introducing the base-engageable mounting member into the one or more slots.

14. The method of claim 11, wherein the shower enclosure further includes at least one interlocking member located on a vertical edge of the surround panel, the at least one interlocking member being connectable to at least one interlocking member of an adjacent surround panel at a corner of the shower enclosure, and wherein the method further includes connecting the at least one interlocking member of the surround panel to the at least one interlocking member of the adjacent surround panel.

15. The method of claim 11, wherein the shower enclosure includes at least two mounting members, each mounting member having a lower portion engageable with one of the one or more engagement features of the base, and an upper portion connectable to a wall or stud in a manner that facilitates adjusting a spacing between the surround panel and the wall or stud, wherein the step of mounting the unit to the base includes connecting the lower portion of each mounting member to a corresponding one of the one or more engagement features of the base, and wherein the step of connecting at least one of the mounting members to the wall or stud includes connecting the upper portion of each mounting member to the wall or stud.

16. A shower enclosure, comprising:

a base having plural engagement features along a peripheral surface of the base;

a surround panel having a front side and a back side, the front side being configured to face an interior of the shower enclosure and the back side having a mounting assembly;

the mounting assembly being engageable with the one or more engagement features of the base;

the mounting assembly being connectable to a wall or stud in a manner that facilitates adjusting a spacing between the surround panel and the wall or stud;

the mounting assembly comprising at least one wall connection assembly having a mounting member-engaging part and a wall-engaging part that are adjustably interconnected for selective positioning relative to each other in a direction normal to the back side of the surround panel; and the surround panel and the mounting assembly being attached together for mounting as a unit to the base, the unit being configured to be made square relative to the base while engaging the base.

17. The shower enclosure of claim 16, wherein the at least one wall connection assembly is adjustable to adjust a spacing between the surround panel and the wall or stud after the unit is in engagement with the base.

18. The shower enclosure of claim 16, wherein one of the wall connection assembly's mounting member-engaging part or wall-engaging part comprises a plurality of slots configured to receive the other of the wall connection assembly's mounting member-engaging part or wall-engaging part.

19. The shower enclosure of claim 16, wherein the one or more engagement features of the base comprise slots and the mounting assembly is configured to be vertically received in the slots.

20. The shower enclosure of claim 16, further including at least one interlocking member located on a vertical edge of the surround panel, the at least one interlocking member being connectable to at least one interlocking member of an adjacent surround panel at a corner of the shower enclosure.

* * * * *